US005442374A

United States Patent [19]

Koizumi

[11] Patent Number: 5,442,374

[45] Date of Patent: Aug. 15, 1995

[54] COLOR DISPLAY

[75] Inventor: Yutaka Koizumi, Yokohama, Japan

[73] Assignee: Ricoh Company, Ltd., Tokyo, Japan

[21] Appl. No.: 21,099

[22] Filed: Feb. 23, 1993

[30] Foreign Application Priority Data

| | | | |
|---|---|---|---|
| Feb. 26, 1992 | [JP] | Japan | 4-039234 |
| Mar. 2, 1992 | [JP] | Japan | 4-044643 |
| Jul. 21, 1992 | [JP] | Japan | 4-194047 |
| Aug. 18, 1992 | [JP] | Japan | 4-219216 |
| Feb. 2, 1993 | [JP] | Japan | 5-015131 |

[51] Int. Cl.[6] ..... G09G 3/34

[52] U.S. Cl. ..... 345/110; 345/108

[58] Field of Search ..... 346/136; 355/270; 340/815.9, 815.8, 815.24, 815.26; 345/108, 110, 31; 358/296; 359/43

[56] References Cited

U.S. PATENT DOCUMENTS

| | | | |
|---|---|---|---|
| 2,180,908 | 11/1939 | Nevinger | 345/108 |
| 4,839,731 | 6/1989 | Saka | 358/296 |
| 5,059,000 | 10/1991 | Kaneko | 359/43 |

*Primary Examiner*—Wing F. Chan

*Assistant Examiner*—Minsun Oh

*Attorney, Agent, or Firm*—Oblon, Spivak, McClelland, Maier & Neustadt

[57] ABSTRACT

A color display has a transparent cover glass having a color stripe filter; a translucent data film located in proximity to a face of the color stripe filter to overlap and display image information; a writing device for writing the information to the data film; an erasing device for erasing the written information from the data film; a writing-erasing controller for controlling operations of the writing and erasing devices; a winder for selectively feeding the data film in normal and reverse directions by forming the data film in a web shape, and winding the data film; a controller for controlling an operation of the winder; and an illuminating device for visualizing these information toward a viewer. In this color display, an image written to the data film can be completely erased rapidly and it is possible to obtain an image having a high quality and a very preferable contrast without any shift in image color. Further, data films can be efficiently exchanged and the color display has a simplified structure and is cheaply manufactured.

13 Claims, 16 Drawing Sheets

COLOR DISPLAY

BACKGROUND OF THE INVENTION

1. Field of the Invention

The present invention relates to a color display for messages and a color display used in an advertising medium field such as an electric ornamental advertisement and used in an artistic field such as an electric ornamental picture frame.

2. Description of the Related Art

In a general color display, a data erasing means for only initialization different from a data writing means is required to initialize a data film. Since the data film is formed in the shape of an endless belt, it is necessary to dispose a device for preventing a shift in movement of the data film so that a structure of the color display is complicated and cost of the color display is increased and no data films can be efficiently exchanged. Further, illuminated light is control led by slight opaque of high polymer of the data film so that an image is slightly opaque and has a very bad contrast and a low quality.

In another general color display using the data film having a sheet shape, it is necessary to rewrite image data of the data film when characters and image colors are changed. Accordingly, a special rewriting device and software for rewriting data are required so that it takes time to dispose such special device and software and no image data can be cheaply made. Further, no image colors can be continuously changed in a state in which the characters and the images are displayed. Therefore, there is a problem that no parallel degree between a color stripe and an image stripe can be adjusted. Namely, a so-called skew adjustment cannot be made.

SUMMARY OF THE INVENTION

It is therefore a first object of the present invention to provide a color display in which an image written to a data film can be completely erased rapidly, and it is possible to obtain an image having a high quality and a very preferable contrast without any, shift in image color, and data films can be efficiently exchanged and the color display has a simplified structure and is cheaply manufactured without any device for preventing a shift in data film.

A second object of the present invention is to provide a color display in which data films having a sheet shape are efficiently exchanged and the contrast of an image is improved and no image data are rewritten to change image colors, and the image data can be easily rewritten and cheaply made, and the image colors can be continuously changed to make a skew adjustment in a state in which characters and the image are displayed.

In accordance with a first structure of the present invention, the above first and second objects can be achieved by a color display comprising a transparent cover glass having a color stripe filter on at least one face thereof; a translucent data film located in proximity to a face of the color stripe filter to overlap and display image information; writing means or writing the information to the data film by selectively making this data film transparent; erasing means for erasing the written information from the data film; writing-erasing control means for controlling operations of the writing and erasing means; winding means for selectively feeding the data film in normal and reverse directions by forming the data film in a web shape, and winding the data film; means for controlling an operation of the winding means; and illuminating means for visualizing these information toward a viewer.

In accordance with a second structure of the present invention, the data film in the first structure is constructed by a thermochromic film for thermally writing and erasing the information, and an initial operating state of the data film is set to a light interrupting state of black coloring, and the information are recorded and displayed by partially setting the light interrupting state to a decolored transparent state by the writing means.

In accordance with a third structure of the present invention, the writing means and the erasing means in the first structure are constructed by the same operating means.

In accordance with a fourth structure of the present invention, the data film in the first structure is constructed by a variable message portion composed of a thermochromic film, and an invariable message portion composed of a normal film on which suitable words are printed in advance.

In accordance with a fifth structure of the present invention, the above first and second objects can be achieved by a color display comprising a color stripe filter having a color stripe on at least one face thereof; a translucent data film located in proximity to the color stripe filter to overlap and display image data; means for slightly changing relative positions of the color stripe filter and the data film periodically or non-periodically by locating the data film in proximity to the color stripe filter to overlap and display the image data; and illuminating means for visualizing these image data toward a viewer.

In accordance with a sixth structure of the present invention, the means for slightly changing the relative positions in the fifth structure is constructed by a cam mechanism engaged with the color stripe filter.

In accordance with a seventh structure of the present invention, the above first and second objects can be achieved by a color display comprising a color stripe filter having a color stripe on at least one face thereof; a translucent data panel located in proximity to the color stripe filter to overlap and display images and having a stripe image; illuminating means for visualizing these images toward a viewer; means for slightly changing relative positions of the color stripe filter and the data panel in a direction perpendicular to a striping direction of the color stripe filter so as to change colors of an image portion; a swinging pin for supporting the data panel through one attachment hole disposed in an eccentric position of the data panel; fine adjusting means disposed to prevent the data panel from being rotated by moment of its empty weight; and driving means for linearly reciprocating the swinging pin.

In accordance with an eighth structure of the present invention, the eccentric position of the data panel in the seventh structure is set to an arbitrary position except for a position of the center of gravity of the data panel, and the fine adjusting means has an adjusting screw coming in contact with a side portion of the data panel.

In accordance with a ninth structure of the present invention, a size of the attachment hole of the data panel in the seventh structure is set such that the swinging pin is detachably attached to the attachment hole.

In accordance with a tenth structure of the present invention, the color display in the seventh structure further comprises a frame body formed in the shape of a picture frame and covering a peripheral portion of a screen of the data panel and a holding member for holding the data panel. A resilient claw member is disposed in the frame body. A receiving member is disposed in the holding member and is detachably engaged with the claw member. The claw member is fitted into the receiving member to attach the frame body to the holding member.

In accordance with an eleventh structure of the present invention, the above first and second objects can be achieved by a color display comprising a color stripe filter having a color stripe on at least one face thereof; a translucent data panel located in proximity to the color stripe filter to overlap and display images and having a stripe image; illuminating means for visualizing these images toward a viewer; means for slightly changing relative positions of the color stripe filter and the data panel in a direction perpendicular to a striping direction of the color stripe filter so as to change colors of an image portion; a driving pin for supporting the data panel through one attachment hole disposed in an eccentric position of the data panel and constantly moved; fine adjusting means disposed to prevent the data panel from being rotated by moment of its empty weight; and driving means for moving the driving pin.

In accordance with a twelfth structure of the present invention, the color display in the eleventh structure has plural fine adjusting means, plural driving pins and plural driving means.

In accordance with a thirteenth structure of the present invention, each of the fine adjusting means, the driving pin and the driving means in the eleventh structure is located in an arbitrary position shifted from a position of the center of gravity of the data panel.

In accordance with a fourteenth structure of the present invention, each of portions of the data panel corresponding to plural fine adjusting means and the driving pin in the eleventh structure is cut in the shape of a broken line along the shape of a preset notch for relief.

In accordance with a fifteenth structure of the present invention, the data panel in the eleventh or fourteenth structure has discrimination marks respectively corresponding to the notch shapes.

In accordance with a sixteenth structure of the present invention, the data panel in the eleventh, fourteenth or fifteenth structure has notches for relief formed in panel portions corresponding to plural fine adjusting means and the driving pin, and a molding plate fitted into each of the notches is detachably disposed.

In accordance with a seventeenth structure of the present invention, the driving means in the eleventh structure moves the driving pin along a curve.

In accordance with an eighteenth structure of the present invention, the driving means in the eleventh structure is approximately arranged in the center of gravity of the color display.

As mentioned above, in accordance with the first structure of the present invention, a color display has a transparent cover glass having a color stripe filter on at least one face thereof; a translucent data film located in proximity to a face of the color stripe filter to overlap and display image information; writing means for writing the information to the data film by selectively making this data film transparent; erasing means for erasing the written information from the data film; writing-erasing control means for controlling operations of the writing and erasing means; winding means for selectively feeding the data film in normal and reverse directions by forming the data film in a web shape, and winding the data film; winding control means for controlling an operation of the winding means; and illuminating means for visualizing these information toward a viewer.

In accordance with the first structure of the present invention, the information are written by the writing means to the data film having the web shape and fed and wound by the winding means in the normal direction. The information are overlapped and displayed in proximity to the cover glass and are illuminated by the illuminating means to visualize the information toward the viewer. The information are erased from the data film by the erasing means while the data film is rewound by the winding means in the reverse direction.

In accordance with the second structure of the present invention, the data film in the first structure is constructed by a thermochromic film for thermally writing and erasing the information, and an initial operating state of the data film is set to a light interrupting state of black coloring. An image having a preferable contrast is displayed by partially setting the light interrupting state to a decolored transparent state by the writing means.

In accordance with the third structure of the present invention, the writing means and the erasing means in the first structure are constructed by the same operating means so that the information can be written and erased by the same operating means.

In accordance with the fourth structure of the present invention, the data film in the first structure is constructed by a variable message portion composed of a thermochromic film, and an invariable message portion composed of a normal film on which suitable words are printed in advance. The information are written to the variable message portion.

In accordance with the fifth structure of the present invention, a color display has a color stripe filter having a color stripe on at least one face thereof; a translucent data film located in proximity to a face of the color stripe to overlap and display image data; means for slightly changing relative positions of the color stripe filter and the data film periodically or non-periodically by locating the data film in proximity to the face of the color stripe to overlap and display the image data; and illuminating means of transmitted light for visualizing these image data toward a viewer.

In the fifth structure, when an image is displayed, the relative positions of the stripe filter and the data film are slightly changed periodically and non-periodically so that the colors of respective portions of displayed characters and images are slightly changed continuously.

In accordance with the sixth structure of the present invention, the relative positions of the stripe filter and the data film in the fifth structure are slightly changed by a cam mechanism engaged with the color stripe filter.

In accordance with the seventh structure of the present invention, a color display has a color stripe filter having a color stripe on at least one face thereof; a translucent data panel located in proximity to the color stripe filter to overlap and display images and having a stripe image; illuminating means for visualizing these images toward a viewer; and means for slightly changing relative positions of the color stripe filter and the data panel in a direction perpendicular to a striping direction of the color stripe filter. A swinging pin supports the data panel through one attachment hole disposed in an eccentric position of the data panel.

In the seventh structure, a driving means makes a predetermined linear reciprocating movement of the data panel through the swinging pin with respect to the color stripe filter, thereby changing the colors of an image portion. A fine adjusting means prevents the data panel from being rotated by moment of its empty weight, thereby making a skew adjustment of the data panel.

In accordance with the eighth structure of the present invention, the eccentric position of the data panel in the seventh structure is set to an arbitrary position except for a position of the center of gravity of the data panel. The adjusting screw of the fine adjusting means comes in contact with a side portion of the data panel and the skew adjustment of the data panel is made by adjusting rotation of the adjusting screw.

In accordance with the ninth structure of the present invention, a size of the attachment hole of the data panel in the seventh structure is set such that the swinging pin is detachably attached to the attachment hole. The swinging pin is fitted into the attachment hole of the data panel to make the predetermined linear reciprocating movement of the data panel.

In accordance with the tenth structure of the present invention, a resilient claw member is disposed in a frame body formed in the shape of a picture frame and covers a peripheral portion of the screen of the data panel in the seventh structure. This claw member is fitted into a receiving member disposed in a holding member to detachably attach the frame body to the holding member.

In accordance with the eleventh structure of the present invention, a color display has a color stripe filter having a color stripe on at least one face thereof; a translucent data panel located in proximity to the color stripe filter to overlap and display images and having a stripe image; illuminating means for visualizing these images toward a viewer; means for slightly changing relative positions of the color stripe filter and the data panel in a direction perpendicular to a striping direction of the color stripe filter; a driving pin for supporting the data panel through one attachment hole disposed in an eccentric position of the data panel and constantly moved; fine adjusting means disposed to prevent the data panel from being rotated by moment of its empty weight; and driving means for moving the driving pin.

In accordance with the eleventh structure of the present invention, the fine adjusting means can make a skew adjustment of the data panel. The driving means moves the data panel along a predetermined curve through the swinging pin with respect to the color stripe filter, thereby changing the colors of an image portion.

In accordance with the twelfth structure of the present invention, the color display in the eleventh structure has plural fine adjusting means, plural driving pins and plural driving means. Each of a plurality of data panels is attached and a skew adjustment thereof is made and each of the data panels is moved along a predetermined curve.

In accordance with the thirteenth structure of the present invention, each of the fine adjusting means, the driving pin and the driving means in the eleventh structure is located in an arbitrary position shifted from a position of the center of gravity of the data panel. In the thirteenth structure, it is possible to prevent the data panel from being rotated by moment of its empty weight.

In accordance with the fourteenth structure of the present invention, each of portions of the data panel corresponding to plural fine adjusting means and the driving pin in the eleventh structure is cut in the shape of a broken line along the shape of a preset notch for relief so that it is possible to attach a plurality of data panels.

In accordance with the fifteenth structure of the present invention, the data panel in the eleventh or fourteenth structure has discrimination marks respectively corresponding to the notch shapes and different driving pins are used by using one kind of data panels.

In accordance with the sixteenth structure of the present invention, the data panel in the eleventh, fourteenth or fifteenth structure has notches for relief formed in panel portions corresponding to plural fine adjusting means and the driving pin. A molding plate is detachably fitted and attached to a normally unused notch to attach the data panel.

In accordance with the seventeenth structure of the present invention, the driving means in the eleventh structure moves the driving pin along a curve so that image colors can be smoothly changed.

In accordance with the eighteenth structure of the present invention, the driving means in the eleventh structure is approximately arranged in the center of gravity of the color display. Accordingly, no center of gravity of the color display is moved even when a transversal arrangement of the color display is changed to a longitudinal arrangement thereof.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a color display in the present invention will next be described in detail with reference to the accompanying drawings.

Figure 1:
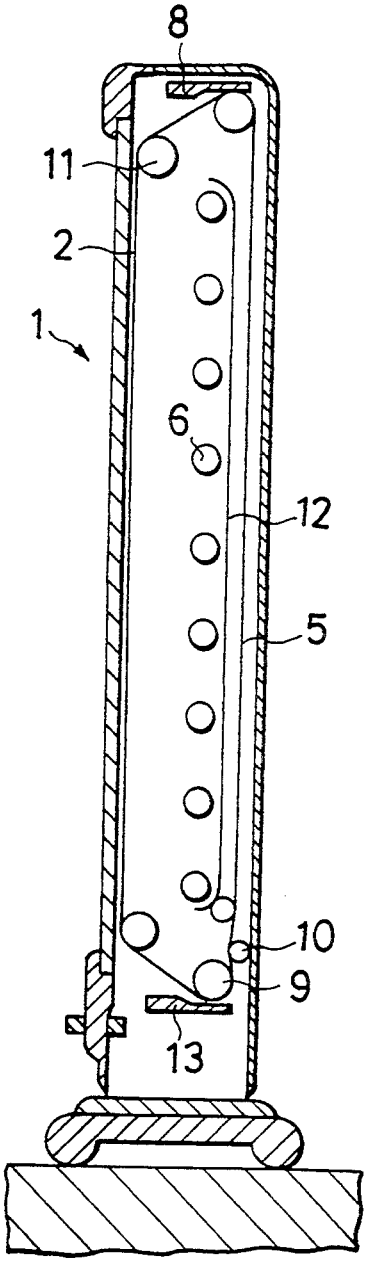
Fig. 1 (PRIOR ART)
FIG. 1 is a schematic longitudinal cross-sectional view of a general color display.
Figure 2:
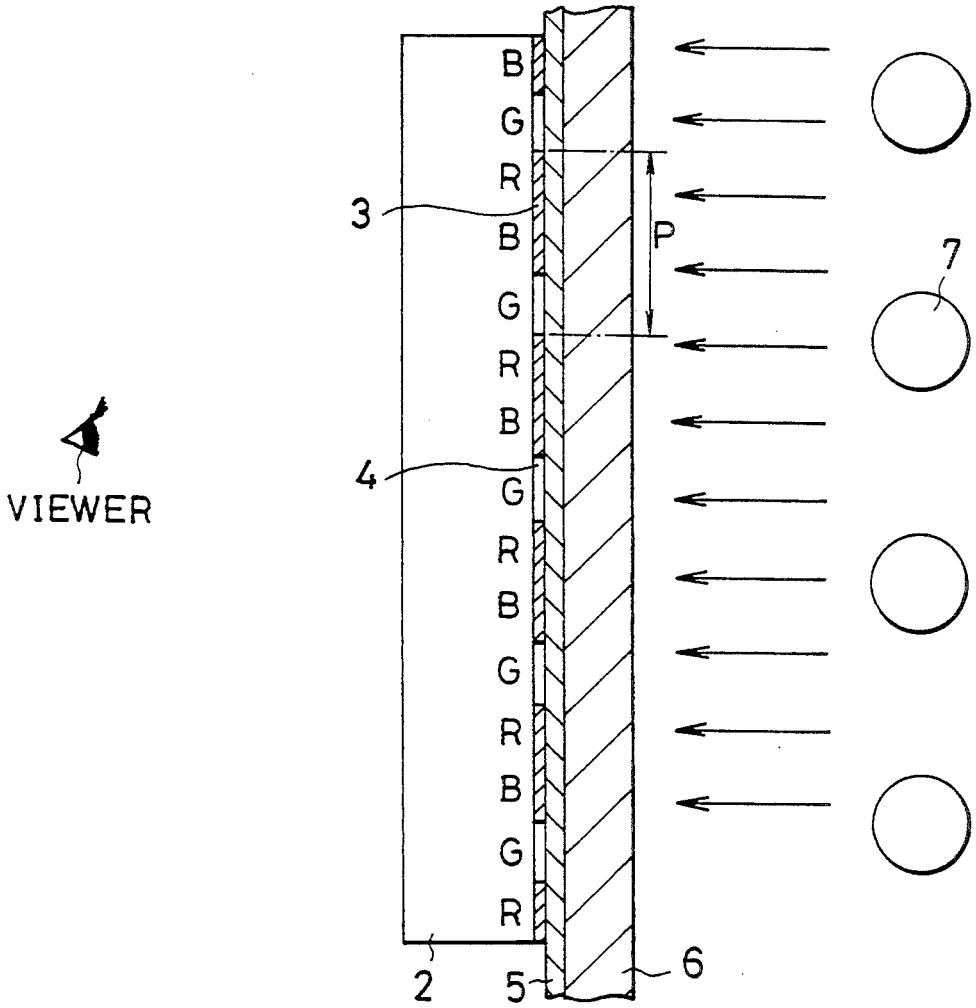
Fig. 2 (PRIOR ART)
FIG. 2 is a schematic longitudinal cross-sectional view showing a display window, a stripe filter, a data film and a back light portion in the color display shown in FIG. 1.
Figure 3:
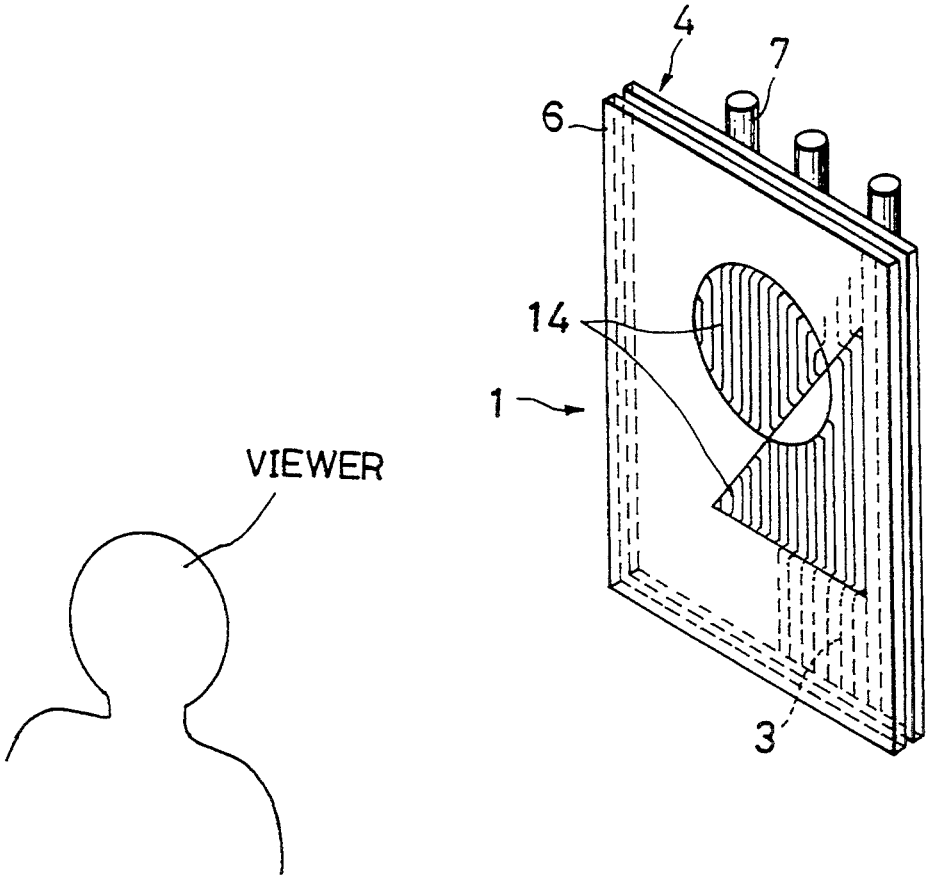
Fig. 3 (PRIOR ART)
FIG. 3 is a schematic perspective view of another general color display.

Each of FIGS. 1 to 3 conventional color displays. This color display has a color stripe filter 4 having a color stripe 3 on the rear face of a colorless transparent display window 2. An endless data film 6 has a data recording layer 5 coming in contact with this color stripe filer 4. An illuminating means 7 is arranged in a position separated from the data film 6.

(1) The data film 6 is moved and circulated by a driving device 9 in an arrow direction to display a different image while the data film 6 is tensioned by an idle roller 10 and a tension roller 11. In the color display 1, an image 14 having a stripe shape is written to the data film 6 by a writing means 13 fixedly arranged downward before a displaying operation is performed. This image 14 is drawn in parallel with a color stripe and is slightly opaque or transparent. The color stripe filter 4 is partially masked with this written image 14 to cut unnecessary light. The color stripe filter 4 is illuminated by a back light 7 from a rear side thereof to visualize a transmitted light image. In this case, a coloring principle (recognition of color) is provided by additive color mixture as shown in FIG. 2. This coloring principle is equal to that of a color liquid crystal, etc. in principle. The displayed image is erased by an erasing means 8 while the data film 6 is moved. In FIG. 1, reference numeral 12 designates a reflecting plate.

(2) FIG. 3 shows a color display in which the data film 6 is formed in the shape of a sheet and a different image is displayed by replacing one sheet with another.

In the color display described in the above item (1), an erasing means for only initialization different from the writing means is required to initialize the data film. Since the data film is formed in the shape of an endless belt, it is necessary to dispose a device for preventing a shift in movement of the data film so that a structure of the color display is complicated and cost of the color display is increased and no data films can be efficiently exchanged. Further, the illuminated light is controlled by slight opaque of high polymer of the data film so that the image is slightly opaque and has a very bad contrast and a low quality.

In the color display using the data film having a sheet shape and described in the above item (2), it is necessary to rewrite image data of the data film when characters and image colors are changed. Accordingly, a special rewriting device and software for rewriting data are required so that it takes time to dispose such special device and software and no image data can be cheaply made. Further, no image colors can be continuously changed in a state in which the characters and the images are displayed. Therefore, there is a problem that no parallel degree between a color stripe and an image stripe can be adjusted. Namely, a so-called skew adjustment cannot be made.

In the following embodiments of the present invention shown in the accompanying drawings, constructional portions similar to those in the general color display are designated by the same reference numerals and explanations about these constructional portions are omitted in the following description. Accordingly, constructional portions different from those in the general color display are mainly explained in the following description.

Figure 4:
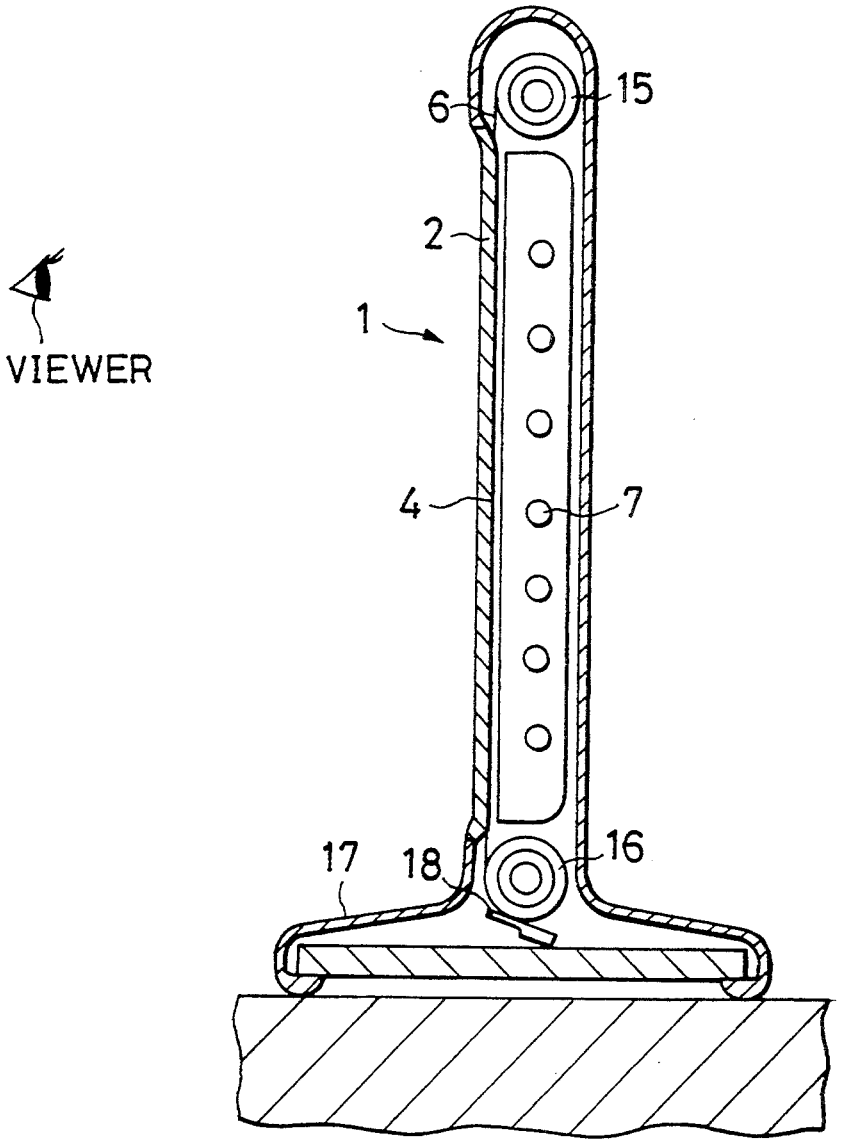
FIG. 4 is a schematic longitudinal cross-sectional view of a color display in accordance with a first embodiment of the present invention.

Each of FIGS. 4 to 8 shows a color display in accordance with a first embodiment of the present invention. FIG. 4 is a longitudinal cross-sectional view of the color display in the first embodiment of the present invention. In FIG. 4, a thermochromic film having a web shape is used as a data film 6. The data film 6 is attached to a winding roller 15 and a rewinding roller 16 respectively disposed in upper and lower portions of a color display 1 inside a body thereof such that the data film 6 can be reciprocated between these rollers. A driving device is constructed by the winding roller 15, the rewinding roller 15, an unillustrated driving means and a control means 17 having a central processing unit (CPU).

The winding roller 15 and the rewinding roller 16 operate the driving means by a command signal of the control means 17 so that the data film 6 is wound around the winding roller 15 in the upper portion of the color display from the lower portion thereof, thereby attaining a displaying state. The data film 6 is rewound around the rewinding roller 16 so that the data film 6 is stored into this rewinding roller 16. A writing erasing means is constructed by the same thermal head 18 and is disposed in an inside lower portion of a display window 2. An adjusting member may be disposed to finely adjust a position of the thermal head 18 at least in leftward and rightward directions.

In this first embodiment, before an image 14 is displayed, the image is thermally written to the data film 6 by the thermal head 18. A writing or erasing operation of the image using the thermal head 18 is controlled by the command signal from the control means 17. In the image writing operation, an entire face of the data film 6 is colored in black and the image on this data film 6 is selectively erased and transparent by controlling and setting a temperature of the thermal head 18 to a first temperature ($T_2$). Required illuminating light is then transmitted through a color stripe filter 4 so that the data film 6 is colored and this color is recognized. After the displayed data film 6 having the rewritten image is used, this data film 6 is reversely fed. The temperature of the same thermal head 18 as the thermal head used in the writing operation in a rewinding process is controlled and set to a second temperature ($T_4$) so that an entire face of the data film 6 is heated. Thus, the entire face of the data film 6 is colored in black so that the image is erased from the data film. No tracking shift in formation of the image is caused since the writing and erasing operations are performed by the same thermal head 18.

In this first embodiment, the width of a color stripe 3 having each of colors of the color stripe filter 4 is determined by the size of a screen in the color display and the number of pixels set at a designing time of the color display. In this embodiment, the width of the color stripe is set to 0.1 to 1 mm per color. The color stripe is formed on a transparent substrate such as a polyester film by a printing technique, etc.

In this first embodiment, the thermal head 18 for writing information is arranged in a constant position. Accordingly, the relation in relative position between the thermal head 18 and the color stripe filter 4 is constant and not changed. Further, since the winding and rewinding operations are performed by using the data film 6 having the web shape, the data film 6 can be moved forward and backward and no color shift is caused even when no device for correcting a shift in movement of the data film is disposed. Accordingly, if the position relation between the thermal head 18 and the color stripe filter 4 is adjusted and optimized at an assembling time of the color display, no writing position is shifted and a coloring operation is accurately performed any time irrespective of the data film 6 located between the thermal head 18 and the color stripe filter 4. Therefore, no color shift is caused on the entire screen.

However, when an advancing direction of the data film 6 is shifted from a striping direction of the color stripe filter 4, a color shift is caused with respect to the above relative position relation as a displaying operation is performed at a terminal end of a display section. Accordingly, a coloring state of the data film 6 becomes bad. The color shift is sometimes caused when the data film 6 is repeatedly used several hundred times and data films are exchanged. To prevent such a color shift from being caused, it is effective to twist the striping direction of the color stripe 3 of the color stripe filter 4 within a plane thereof, thereby making a skew adjustment. Accordingly, it is desirable to dispose a means for making the skew adjustment in a unit of 0.1 mm although this skew adjusting means is not illustrated in FIG. 4.

Figure 5:
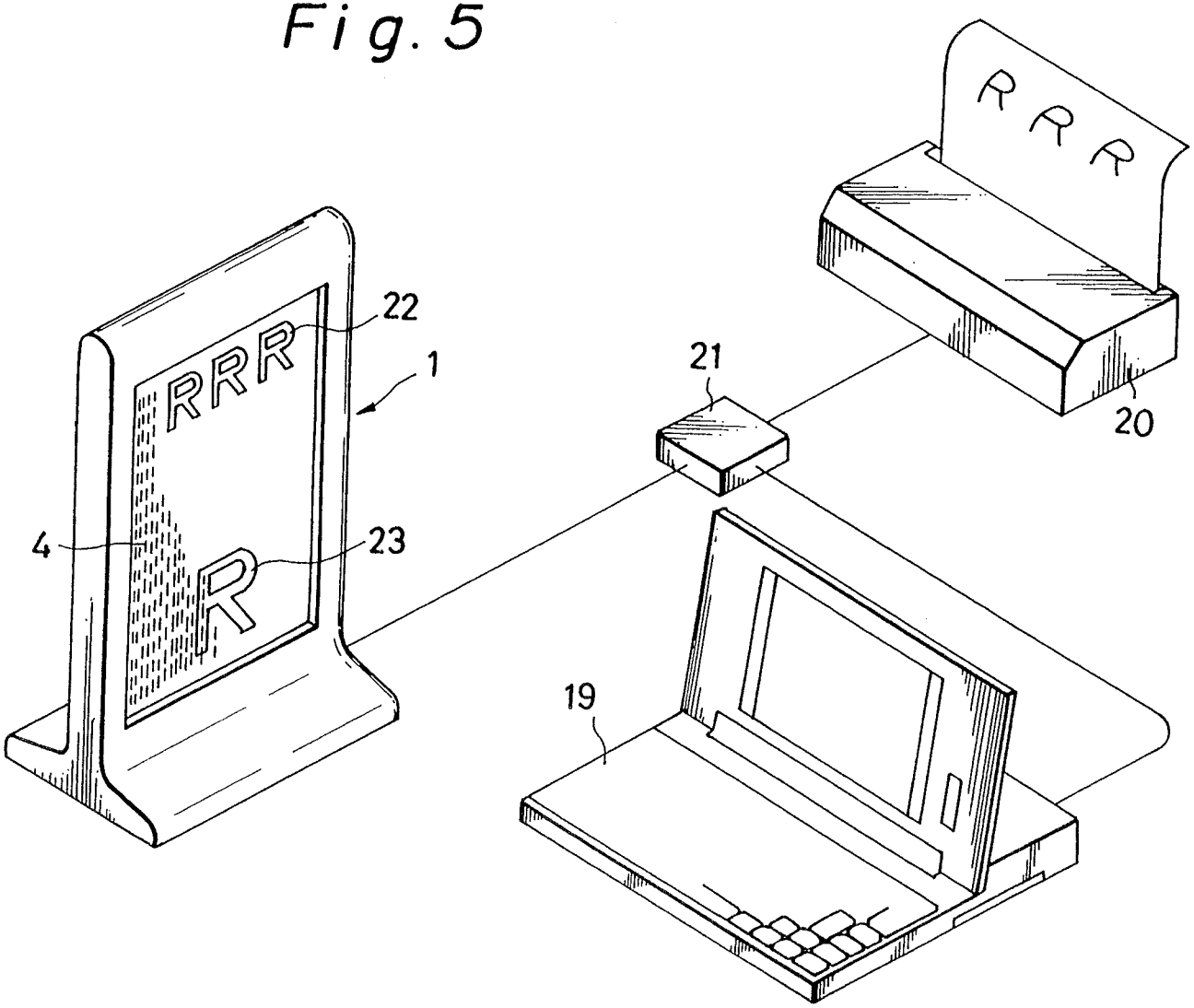
FIG. 5 is an explanatory view showing one example of a using form of the color display in the first embodiment of the present invention.

FIG. 5 is an explanatory view showing one example of a using form of the color display in the first embodiment. An original is made by a computer 19 and data of the original are normally transmitted to a printer 20 and are printed out as a hard copy from the printer 20. However, there is a case in which these data are changed and revised several times until the original is completely made by the computer 19. In this case, it takes time to print these data out every change and revision and used sheets of paper are uselessly wasted. One of reasons for such problems is that a lap top personal computer and a note type personal computer are used as the computer 19 in many cases and a display of each of these personal computers is constructed by a monochromatic display so that it is very difficult to treat color information by such a monochromatic display. Another reason is that, for example, no one picture can be simultaneously displayed on the entire screen at an equal magnification even when a color display is provided by a disk top personal computer. Therefore, it is very difficult to provide the color display in consideration of a layout.

Accordingly, the present invention provides an effective complementing system for solving such a situation. Namely, before data are transmitted to the printer 20, a switching device 21 is switched and these data are transmitted to the color display body and one picture is simultaneously displayed in a certain color on the entire screen (having size A4) at the equal magnification. After image colors and a layout are sufficiently considered, the operation of the switching device 21 is returned to an original switching operation and the data are transmitted to the printer 20 and can be printed out.

In the operation of a personal computer, an operator can temporarily display a document for reference, drawings, etc. and can work with reference to these information. Accordingly, working efficiency and the quality of an image are improved. The writing operation of information of the color display 1 in the present invention is performed by a digital signal. Accordingly, the information are made as a digital signal by the computer 19 and are converted to a digital signal by the computer 19 by reading a hard original such as a printed material by a scanner.

Figure 6:
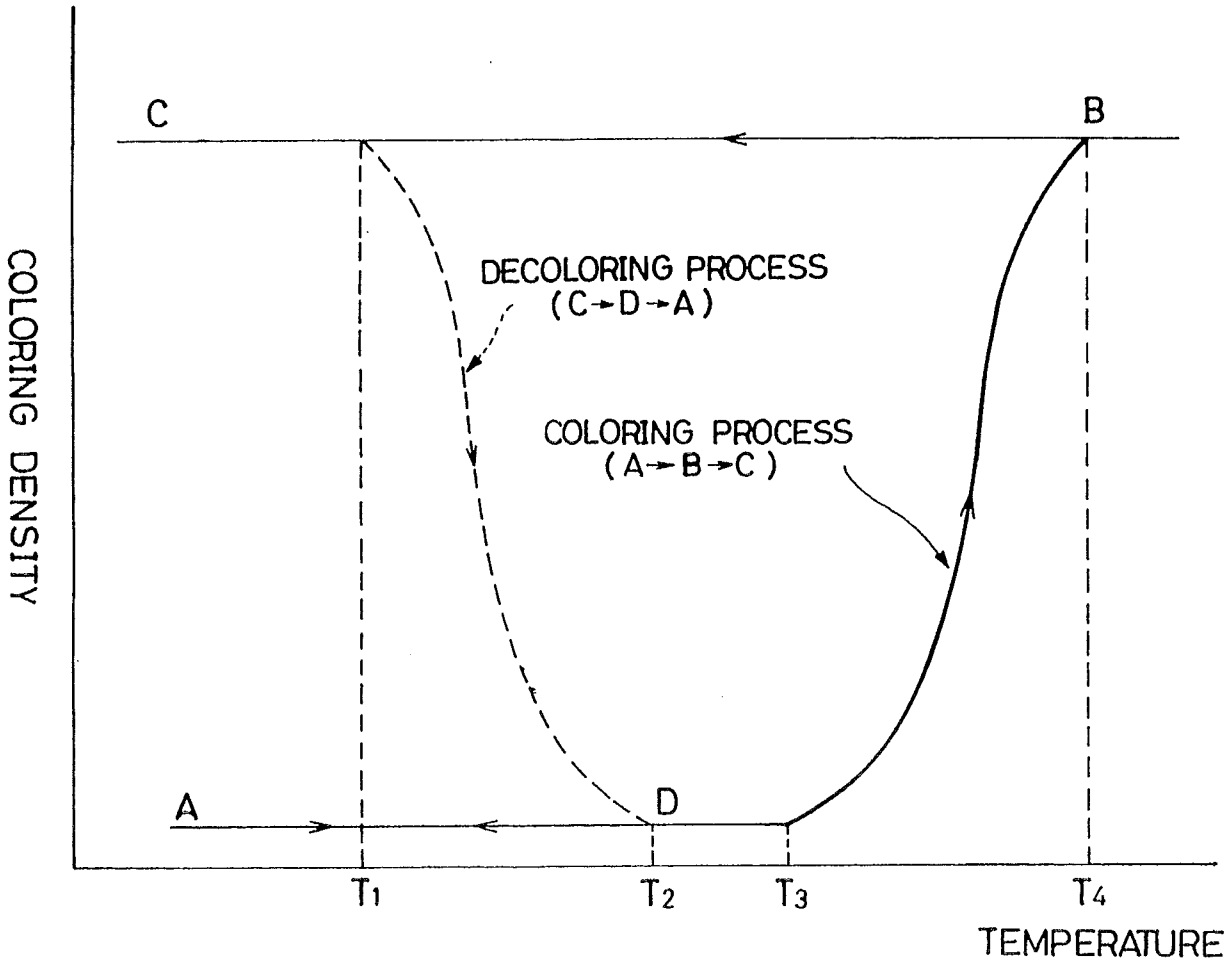
FIG. 6 is a characteristic graph showing the relation between a coloring density and a temperature of a thermochromic film in the color display in the first embodiment of the present invention.

In this embodiment, a thermochromic film is used as the data film 6. FIG. 6 shows characteristics of a coloring density and a temperature of the thermochromic film. In FIG. 6, when the temperature of the thermochromic film is increased from point A, the thermochromic film begins to be colored at temperature $T_3$ through temperatures $T_1$ and $T_2$. The coloring density of the thermochromic film reaches a maximum density at point B and temperature $T_4$. In this embodiment, black is used as a color for coloring. This maximum density is maintained even when the thermochromic film is cooled and left until point C showing a room temperature as it is. This state is set to an initial condition. When the thermochromic film is heated from this state of point C, the thermochromic film begins to be decolored at the temperature $T_1$ and becomes transparent at the temperature $T_2$ and point D. This transparent state is maintained even when the thermochromic film is left as it is.

Thus, a portion of the thermochromic film heated at the temperature $T_2$ becomes transparent so that light is transmitted through this film portion. This heating operation is performed in a writing process of information using the thermal head 18. An entire face of the thermochromic film is colored in black in the state of point C and this thermochromic film is partially decolored and transparent in accordance with data. The thermochromic film is then set to overlap the color stripe filter 4 and light of a back light 7 is transmitted through an overlapping portion so that the color stripe filter 4 is colored.

When the thermochromic film is heated from the above temperature $T_3$ to the temperature $T_4$ and is then cooled until the room temperature, a coloring state of the thermochromic film is again set to an opaque black state. Accordingly, these heating and cooling operations are performed in an erasing process of information using the thermal head 18. In this case, the entire face of the thermochromic film may be heated. Such a thermochromic film can be repeatedly used several hundred times and no energy is specially required to hold the display of information.

Further, in this embodiment, a thermochromic method is used as a means for writing and displaying data. However, it is possible to use a suitable image forming system for writing information to the data film and visualizing and erasing the information from the data film. For example, this image forming system can be constructed by a direct electrostatic photographing system using a translucent organic semiconductor photosensitive body as the data film. This image forming system can be also constructed by an indirect electrostatic photographing system using organic and inorganic photosensitive bodies, an electrostatic recording system, etc.

Figure 7:
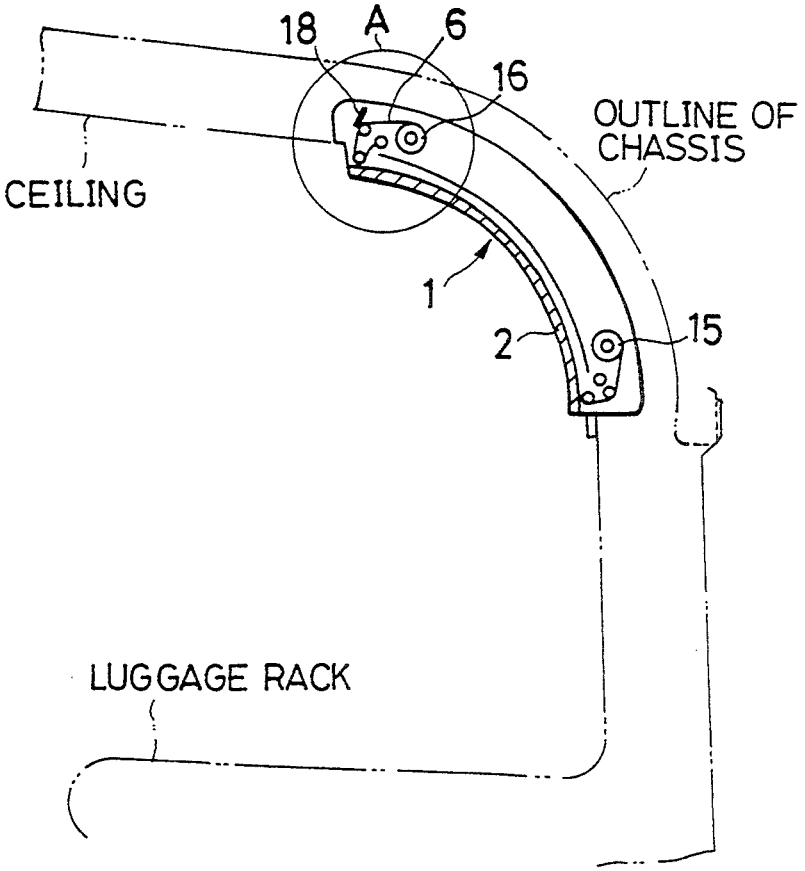
FIG. 7 is an explanatory view of the color display in the first embodiment using a stripe filter and a data film having large curvature.
Figure 8:
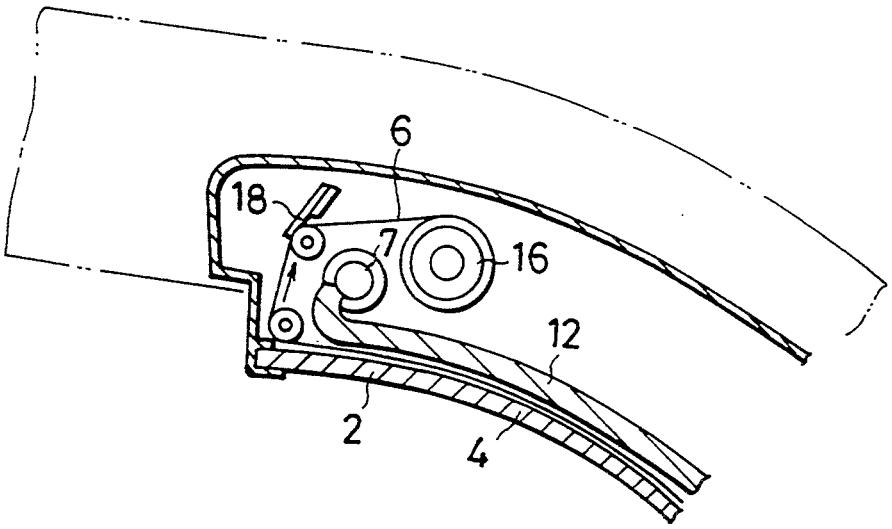
FIG. 8 is an enlarged view of section A of the color display in FIG. 7.

In this embodiment, when a sheet of translucent paper is used as a substrate of the data film 6, a coarse face layer is formed between the color stripe filter 4 and the data film 6. Accordingly, when the data film 6 is fed, it is possible to prevent the color stripe filter 4 and the data film 6 from being stuck to each other. Further, when faces of the data film 6 and the color stripe filter 4 are constructed by mirror faces, an interference fringe of light is caused in an air layer between these faces, thereby forming a noise image. However, occurrence of such a phenomenon can be prevented by the above structure of the color display in the present invention. Since the color stripe filter 4 and the data film 6 are not stuck to each other, the color display can be also used as a display for guiding train lines within a train, a display for train running situations, a side advertising panel within a train, etc. respectively using the display window 2 having extremely large curvature as shown in FIGS. 7 and 8.

The data film 5 has a length slightly exceeding that of one screen and is used while the data film 6 is wound and rewound. However, a leader portion may be disposed in the data film 6 in advance such that a length of this leader portion is approximately equal to that of the data film 6. As shown in FIG. 5, a message such as an invariant message 22 prepared in advance may be printed on this leader portion.

Figure 9:
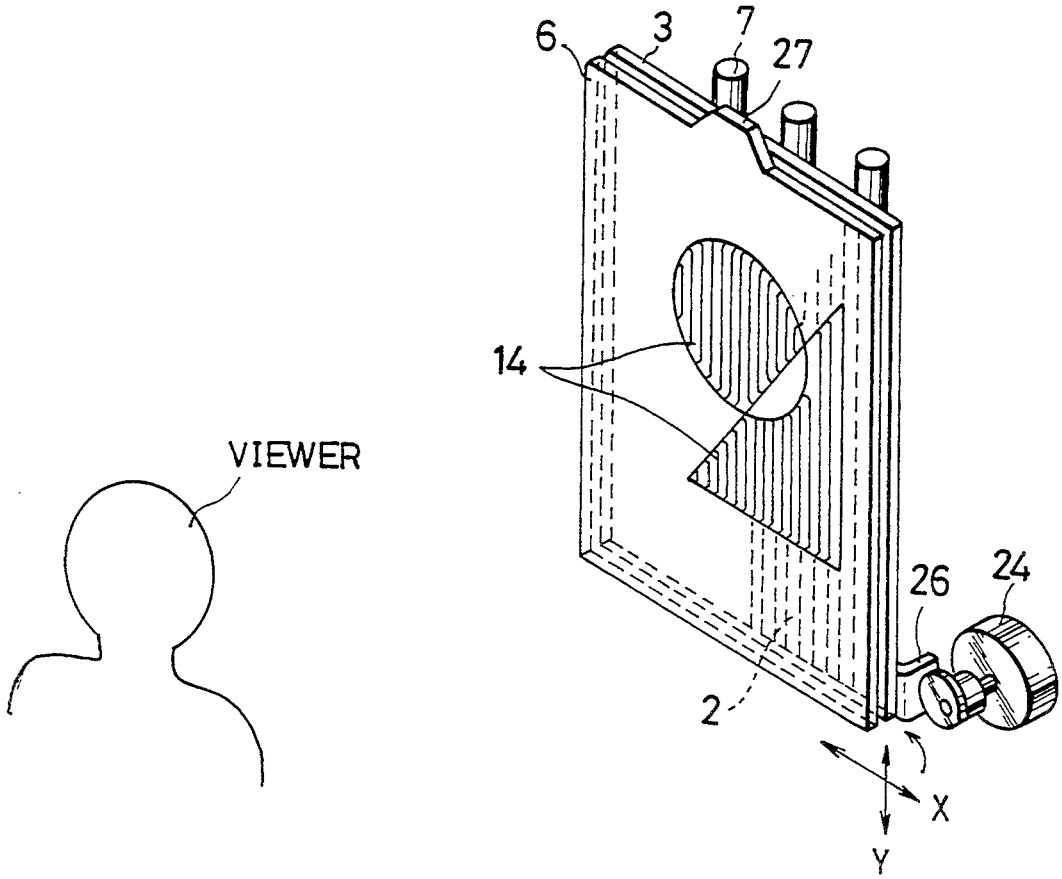
FIG. 9 is a schematic perspective view of a color display in accordance with a second embodiment of the present invention.

FIG. 9 shows a color display in accordance with a second embodiment of the present invention. In FIG. 9, a color stripe filter 4 has a color stripe 3 on one side thereof. A translucent data film 6 has a sheet shape. In this data film 6, image data are written onto a face of the color stripe 3. A displaying operation is performed in a state in which the data film 6 is located in proximity to the color stripe filter 4 and overlaps the color stripe filter 4. The color display in this second embodiment has a cam mechanism engaged with the color stripe filter 4 and slightly changing relative positions of the color stripe filter 4 and the data film 6 periodically and non-periodically. This color display further has an illuminating means 7 as a back light for visualizing the image data toward a viewer.

The above cam mechanism has a first motor 24 and a first eccentric cam 25 attached to a shaft of the first motor 24 to change the relation in relative position between the color stripe filter 4 and the data film 6. The color stripe filter 4 has a first cam follower 26 engaged with the first eccentric cam 25. The first cam follower 26 is pressed against the first eccentric cam 25 by an unillustrated biasing member and is moved as the first eccentric cam 25 is rotated. Thus, the color stripe filter 4 is slightly slid continuously and displaced in the transversal direction of an X-axis shown in FIG. 9 while the color stripe 3 and an image 14 formed by transparent and black stripes are relatively held in parallel with each other. A displacing amount of the color stripe filter 4 is preferably set to at least one pitch of the color stripe 3. This displacing amount depends on a size of the color display, resolution of the image, etc. and is preferably set to about 0.3 to 3 mm.

A desirable displacing amount of the color stripe filter 4 in the X-axis direction and a changing speed thereof are controlled by an unillustrated controller by setting operating conditions and programs in advance by an operator. When no relation in relative position between the color stripe filter 4 and the data film 6 is fixedly set, colors of respective portions of the image are slightly changed continuously by slightly changing this relative position relation with the passage of time. Similar effects can be obtained even when the cam follower 26 is disposed in the data film 6 and the relation in relative position between the data film 6 and the color stripe filter 4 is changed.

In the second embodiment, the color stripe filter 4 is slightly moved continuously and displaced in the transversal direction of the X-axis shown in FIG. 9 while the color stripe 3 and the image 14 formed by transparent and black stripes are relatively held in parallel with each other. Thus, the colors of respective portions of the image 14 formed by the transparent and black stripes are slightly changed. The colors of these image portions are continuously changed through a half tone color with respect to each of blue, green, red, cyan, magenta and yellow.

In the second embodiment, the image 14 is formed by black and transparent stripes with black ink, etc. such that a desirable color is transmitted through a transparent substrate of the data film 6. The image 14 is most simply and accurately formed on the data film 6 by using application software for forming an image in a CAD or personal computer. However, an outline of the image may be inputted manually or a scanner. In this case, the seal of a stripe pattern prepared in advance with respect to only a desirable portion of the image may be cut in a desirable shape and stuck so that it is very easy to manually make the outline of the image. A picture drawing member such as black ink is normally used in the formation of the image 14. However, no color of the picture drawing member is especially limited to black. Accordingly, the picture drawing member having another color may be used. In this case, the image is set in a state in which the image is partially covered with a filter of this color.

A forming means of the data film 6 for writing the image 14 may be constructed by various kinds of printing means such as a thermosensible coloring means, an electrostatic printing means, a silver salt photographing means, etc. The image 14 may be formed by a chromatic transparent printing-drawing means. When a portion of the image is colored in white, this image portion is set to a transparent portion in which no image 14 is written. In contrast to this, when a portion of the image is colored in black, this image portion is colored in black without any transparent portion. Further, with respect to an image portion unnecessary to change colors, the image 14 is erased and a transparent filter of a desirable color such as colored cellophane is stuck onto this image portion.

A tab 27 is disposed in a central upper portion of the data film 5 to easily insert and take out the data film 6 when images are exchanged.

In a color display in accordance with a third embodiment of the present invention, a second cam mechanism is disposed in the color stripe filter 4 although the color display having this second cam mechanism is not illustrated. The second cam mechanism is constructed such that the second cam mechanism rotates and displaces the color stripe filter 4 in the longitudinal direction of a Y-axis and simultaneously displaces the color stripe filter 4 in the X-axis direction. Thus, the color stripe filter 4 can be twisted on the same plane by a combined displacement thereof on the X and Y axes. The other constructions are similar to those in the first embodiment. In this third embodiment, a picture is colored in rainbow colors so that an image of the picture can be represented by using abundant colors.

In the second and third embodiments, the color display can be applied to an image display unit of a projecting type such as OHP, a color converting element such as a magnetic force color converting element, etc.

Figure 10:
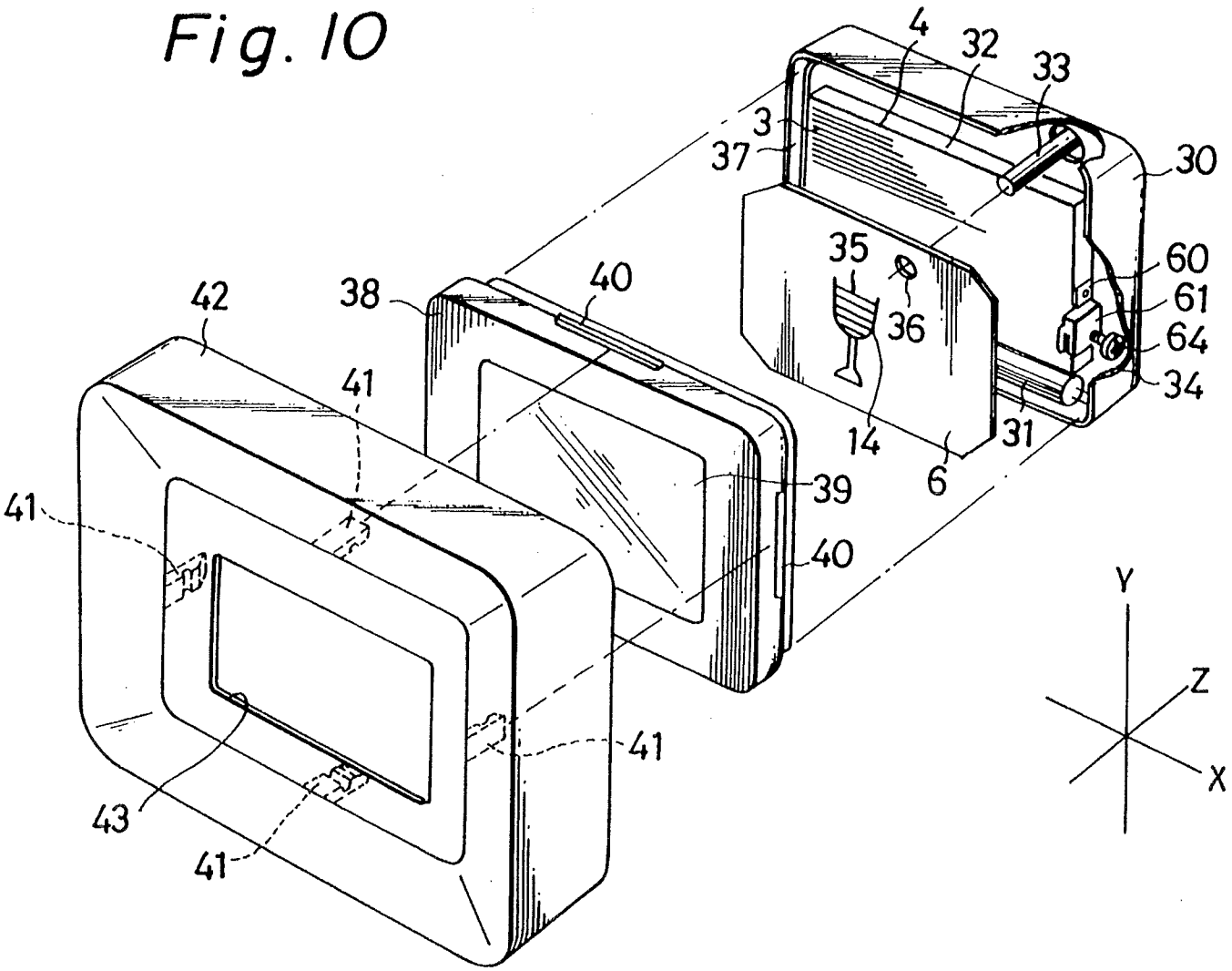
FIG. 10 is an exploded perspective view of a color display in accordance with a fourth embodiment of the present invention.

FIG. 10 shows a color display in accordance with a fourth embodiment of the present invention. In FIG. 10, a body frame 30 is formed in the shape of a box. A fluorescent lamp 31 is arranged as an illuminating means in a lower inside portion of the body frame 30 in a Y-axis direction as a vertical direction.

A light guide plate 32 is made of acrylic resin and is fixed by a suitable fixing means to the body frame 30 just above the fluorescent lamp 31. A color stripe filter 4 is disposed on a surface of this light guide plate 32. A striping direction of a color stripe 3 is parallel to an X-axis direction.

In FIG. 10, a swinging pin 33 is extended through the body frame 30 and is projected in a position located on a right-hand side with respect to a position of the center of gravity of the light guide plate 32 and located above this position of the center of gravity seen from an upper this side in a Z-axis direction. A fine adjusting means 34 is disposed in a right-hand side portion of the light guide plate 32 to make a skew adjustment of a data film 6 formed in the shape of a panel.

The data panel 6 is constructed by a translucent plate and has a size approximately equal to that of the light guide plate 32. An image 14 is formed on a surface of the data panel 6. An image stripe 35 is formed in a region of this image 14 in which a color display and colors can be changed.

An attachment hole 36 is formed in an eccentric position of this data panel 6 shifted from a position of the center of gravity of the data panel 6. This attachment hole 36 has a size set such that the swinging pin 33 is detachably attached to the attachment hole 36. When the swinging pin 33 is inserted into this attachment hole 36 and the data panel 6 overlaps the color stripe filter 4, the data panel 6 is rotated by moment of its empty weight around the swinging pin 33 in the counterclockwise direction since the attachment hole 36 is located in the eccentric position.

The fine adjusting means 34 is located in a position for preventing this rotation of the data panel 6. The data panel 6 is attached to an attaching member in a state in which a side portion of the data panel 5 comes in contact with the fine adjusting means 34 so that the rotation of the data panel 6 is prevented by the fine adjusting means 34.

As described in detail later, an inclination of the data panel 6 is adjusted by a skew adjusting function of this fine adjusting means 34. Further, striping directions of the image stripe 35 and the color stripe 3 are adjusted such that these directions are in conformity with each other.

The swinging pin 33 constitutes one portion of a driving means and is linearly reciprocated by restricting a movement of the swinging pin 33 in the Y-axis direction.

A step portion 13 is formed inside the body frame 30 along an entire circumferential portion thereof. A body cover 37 is fitted and mounted to this step portion 13. A transparent cover glass 39 is disposed in a central portion of the body cover 37. A projection 40 is formed in a circumferential side portion of the body cover 37.

A frame body 42 is made of synthetic resin and is formed in the shape of a picture frame and has a claw 41 engaged with the projection 40. The frame body 42 is attached to the body cover 37 by engaging the claw 41 with the projection 40. Appearance of the color display can be improved by disposing the frame body 42 formed in the shape of a picture frame. A rectangular opening portion 43 is formed in a central portion of the frame body 42. The image 14 on the data panel 6 can be visualized through this opening portion 43.

Figure 11:
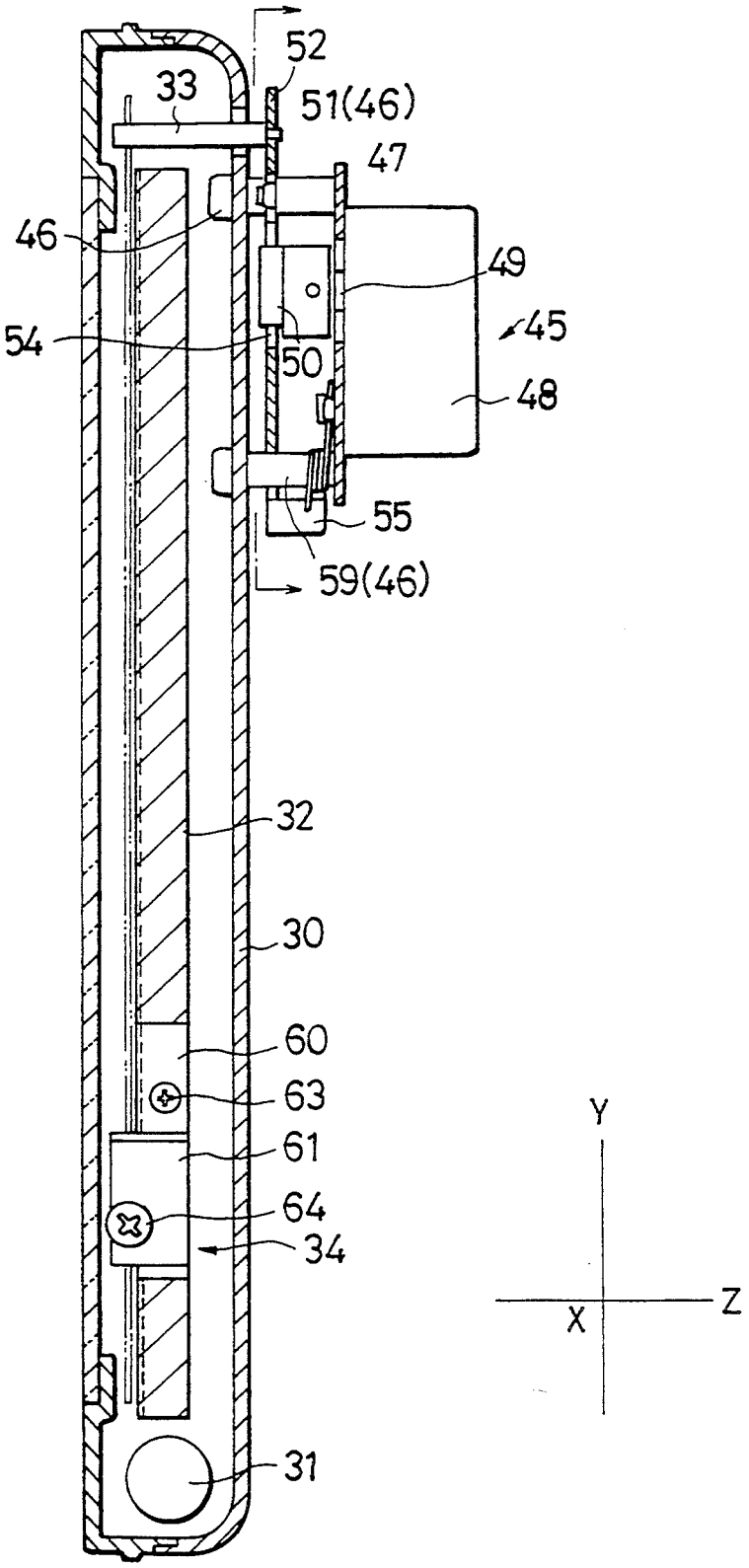
FIG. 11 is a longitudinal cross-sectional view of the color display in the fourth embodiment of the present invention.
Figure 12:
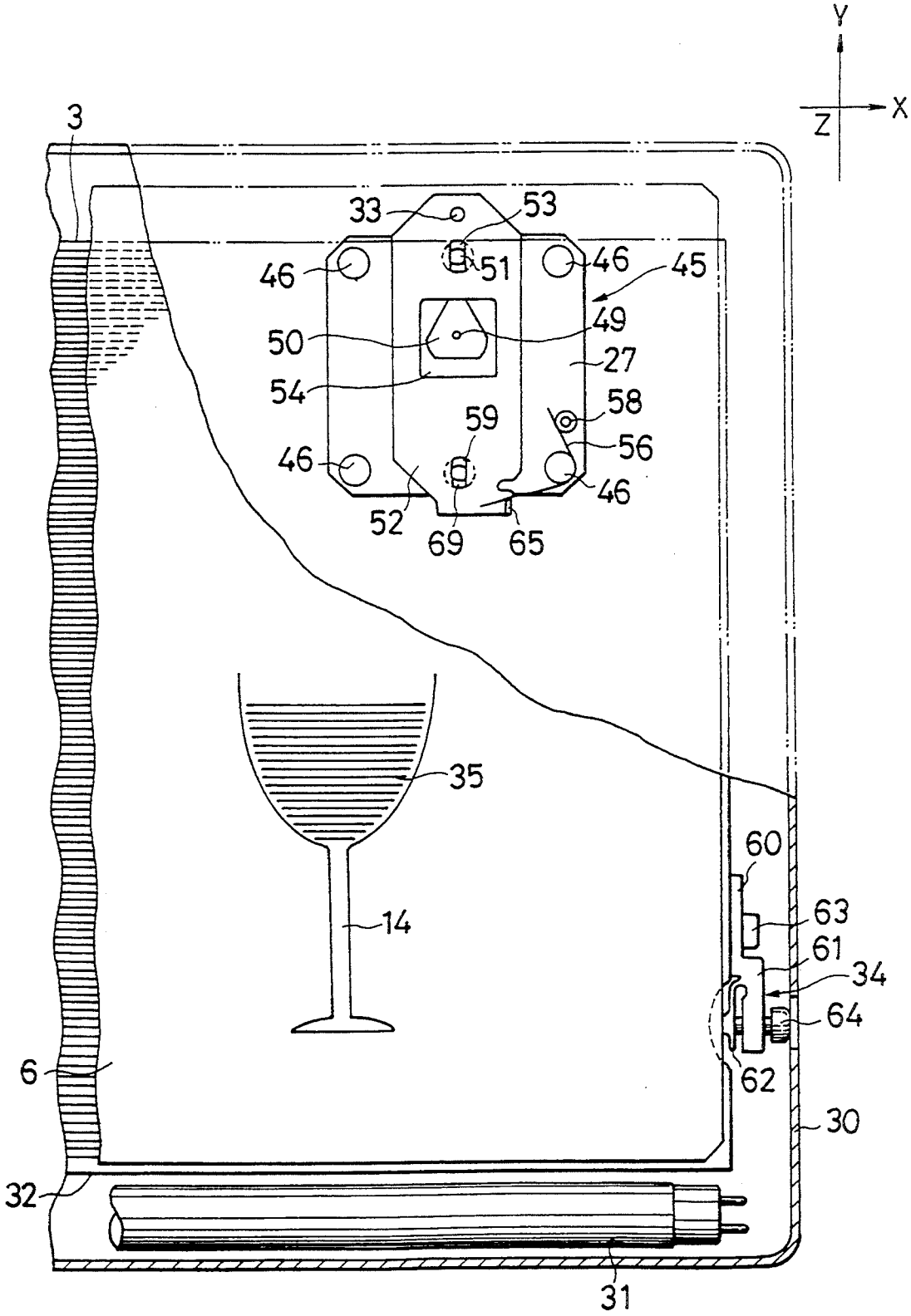
FIG. 12 is a front view for explaining a main portion of the color display in the fourth embodiment of the present invention.

A driving means 45 including the swinging pin 33 will next be described. As shown in FIGS. 11 and 12, four supporting screws 46 are screwed into the body frame 30. A motor attaching plate 47 is fixed to end portions of these supporting screws 46 in a state in which the motor attaching plate 47 is spaced apart from the body frame 30. A motor 48 is fixed to the motor attaching plate 47 and is constructed by an electric motor.

An output shaft 49 of the motor 48 is located between the frame 30 and the motor attaching plate 47. A cam 50 is attached to this output shaft 49. For example, a rotational speed of this cam 50 is set to 1 to 3 revolutions per minute.

Two shafts 51 and 59 are projected on a side of the body frame 30 and are inserted and attached to the motor attaching plate 47. The shafts 51 and 59 are formed such that each of end portions of these shafts has a small diameter. These small diameter portions of the shafts 51 and 59 are fitted into elongated holes 53 and 69 formed in a swinging plate 52 (see FIG. 12). End portions of these small diameter portions have large diameters to prevent the small diameter portions from being pulled out of the elongated holes 53 and 69. The elongated holes 53 and 69 are extended in a Y-axis direction. Accordingly, the swinging plate 52 are guided by the elongated holes 53 and 69 and can be reciprocated in the Y-axis direction. A rectangular opening portion 54 is formed in an intermediate portion of the swinging plate 52. The cam 50 is disposed within this opening portion 54.

A bent portion 55 is formed on one end side of the swinging plate 52 in a side portion opposite to a side of the swinging pin 33 (see FIG. 11). A twisted opening leg spring 56 is wound around a supporting screw 46 in the vicinity of this bent portion 55. One end of this spring 56 is engaged with the bent portion 55. The other end of the spring 56 is engaged with a pin 58 attached to the motor attaching plate 47. Force directed toward the fluorescent lamp 31 in the Y-axis direction is applied to the swinging plate 52 by force in an opening direction of the twisted opening leg spring 56. A movement of the swinging plate 52 by this directional force is prevented since a side portion of the opening portion 54 comes in contact with the cam 50. Namely, the swinging plate 52 is pressed against the cam 50 by resilient force of the twisted opening leg spring 56.

In accordance with the above structure, the cam 50 is rotated when the motor 48 is driven. Thus, the swinging plate 52 is linearly reciprocated in the Y-axis direction in accordance with this rotation of the cam 50. A stroke of this reciprocating or swinging movement is determined by the cam 50 and is set to one pitch p shown in FIG. 2.

Figure 13:
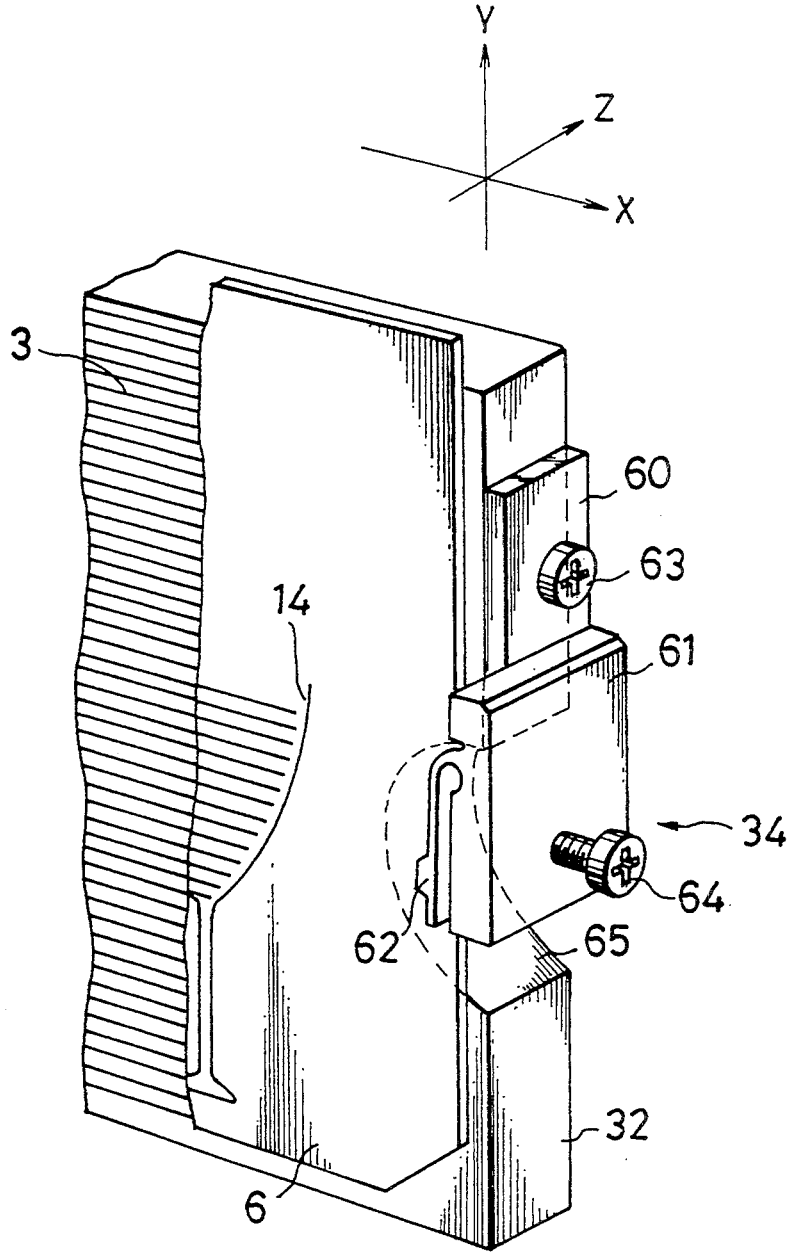
FIG. 13 is a perspective view showing a main portion of the color display in the fourth embodiment of the present invention and explaining a variable fine adjusting means in this color display.

The fine adjusting means 34 will next be described. As shown in FIG. 13, this fine adjusting means 34 is disposed in a side portion of the light guide plate 32. The fine adjusting means 34 is composed of a base end portion 60, an overhung portion 61 and a branching portion 62. The base portion 60 is fixed to the light guide plate 32 by a screw. The branching portion 62 is swung resiliently and freely around a portion as a supporting point connected to the overhung portion 61. An adjusting screw 64 is screwed into the overhung portion 61. An end tip portion of this adjusting screw 64 comes in contact with the branching portion 62. A side portion of the light guide plate 32 opposite to the branching portion 62 is cut in an are shape to form a notch 55 such that a swinging amount of the branching portion 62 is secured, thereby securing an adjusting amount of the movement of the data panel 6.

The attachment hole 36 of the data panel 6 is formed in the eccentric position shifted from the position of the center of gravity of the data panel. The data panel 6 is supported by inserting the swinging pin 33 into this attachment hole 36. Concretely, the attachment hole 36 is formed in a position in which a side portion of the data panel 6 comes in contact with the branching portion 62. Accordingly, if the adjusting screw 64 is rotated, a pressing degree of the branching portion 62 pressed by the end tip of the adjusting screw 64 is changed. Therefore, the data panel 6 is rotated around the swinging pin 33 as a supporting point. Thus, the striping directions of the color stripe 3 and the image stripe 35 can be adjusted such that these directions are in conformity with each other.

Figure 14:
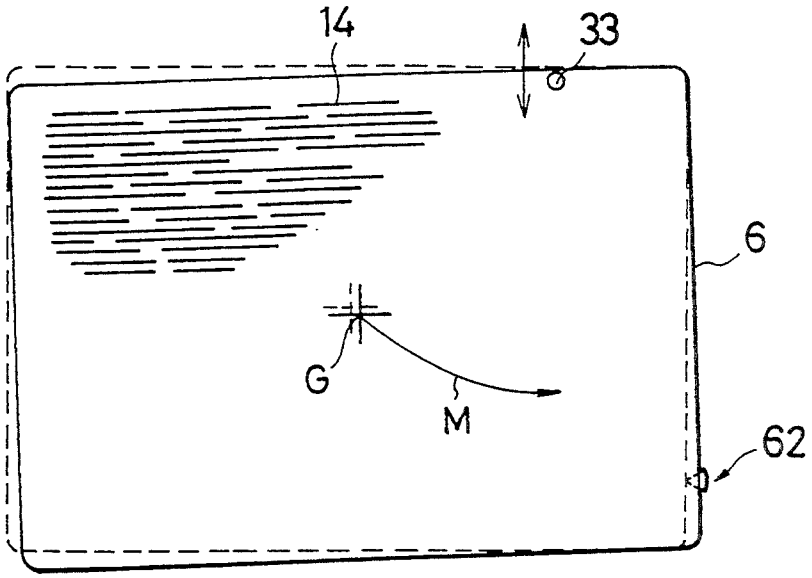
FIG. 14 is a view for explaining the moment of rotation of a data panel in a state in which the color display in the fourth embodiment of the present invention is transversally arranged.

In the above description, the relation between the center G of gravity of the data panel 6, the swinging pin 33 (the attachment hole 36) and the branching portion 62 is provided as shown in FIG. 14. The moment of rotation of the data panel 6 is directed toward the branching portion 62 as shown by an arrow direction M. Accordingly, it is possible to adjust the inclination of the data panel using the fine adjusting means 34.

Figure 15:
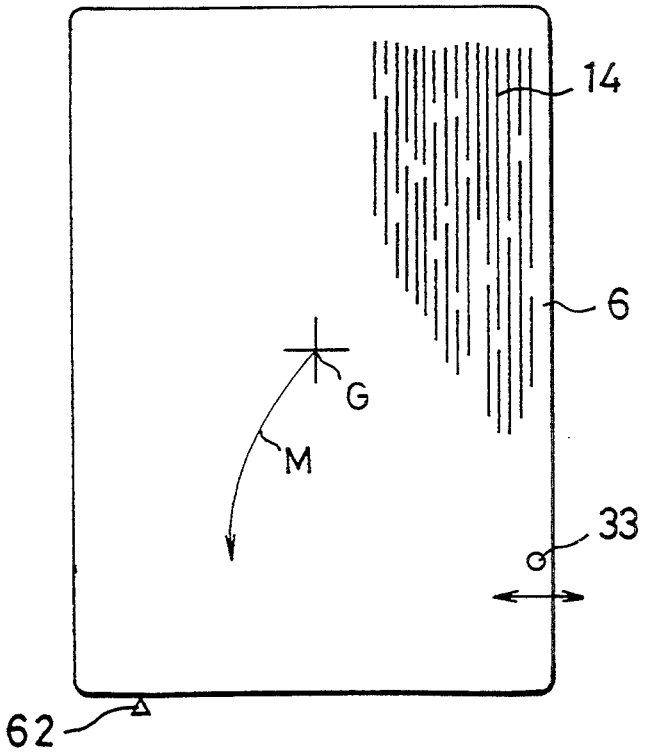
FIG. 15 is a view for explaining the moment of rotation of the data panel in a state in which the color display in the fourth embodiment of the present invention is longitudinally arranged.

The moment M of rotation of the data panel 5 is also directed toward the branching portion 62 even when the color display 1 is rotated 90 degrees to attain a displaying state shown in FIG. 15. Accordingly, the inclination of the data panel 6 can be finely adjusted in any operating state of the color display. Further, the colors of an image can be changed by swinging the swinging pin 33.

In this embodiment, data panels 6 can be easily exchanged. It is also easy to make a skew adjustment of the data panel by the fine adjusting means 34. Further, the data panel 6 is smoothly moved and the colors of an image on the data panel can be smoothly changed. Since a single attachment hole is disposed in the data panel 6, it is easy to process the data panel 6. Further, since the attachment hole is located in an asymmetric position, there is no error in recognition of front and rear faces of the data panel and no high accuracy in processing of the data panel is required.

In this embodiment, the color display 1 can be arranged longitudinally or transversally. Further, the frame body 42 is formed in the shape of a picture frame so that the frame body 42 looks good in appearance and it is easy to detach the frame body 42 from the color display.

Figure 16:
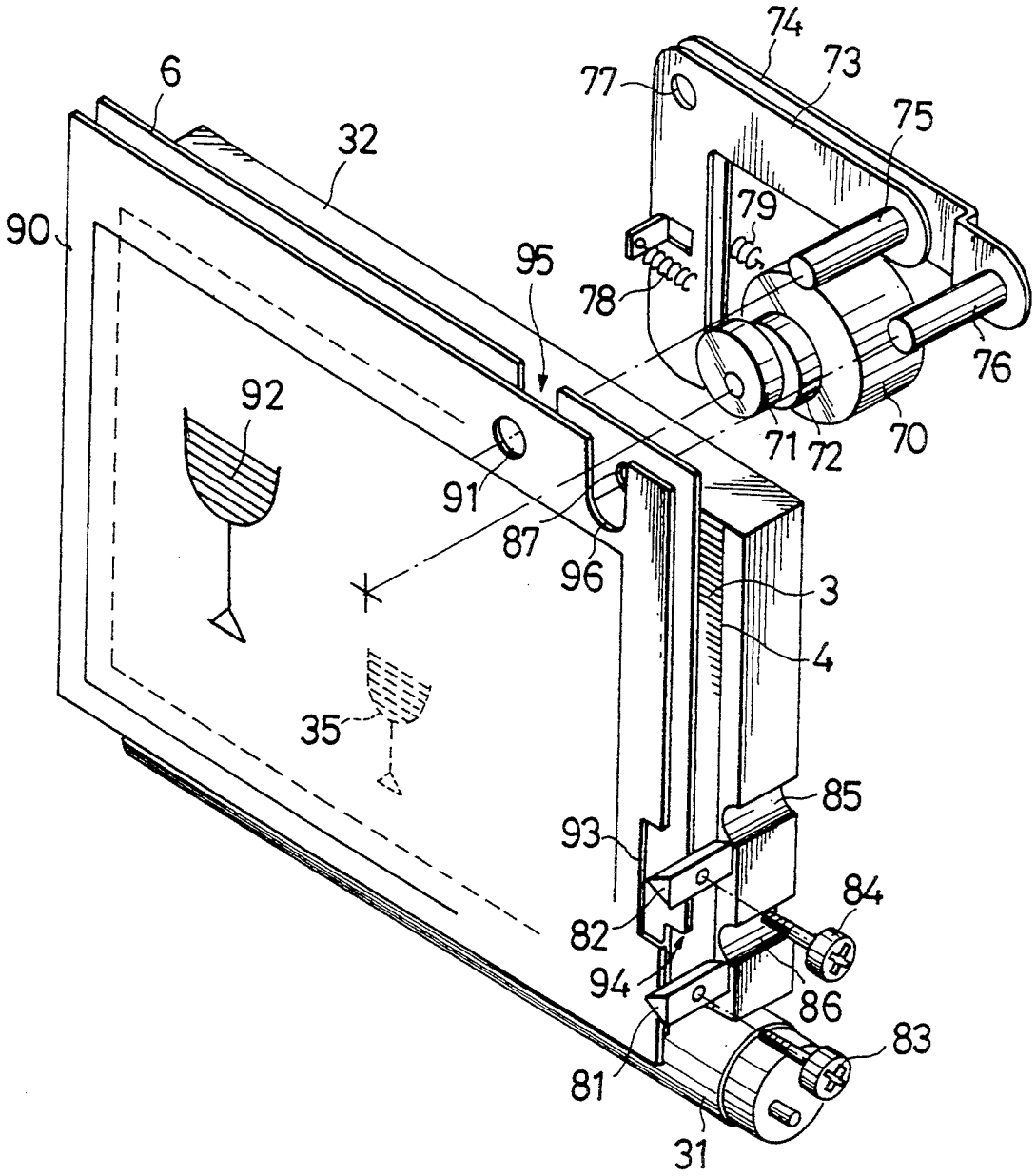
FIG. 16 is an exploded perspective view of a color display in accordance with a fifth embodiment of the present invention.

FIG. 16 shows a color display in accordance with a fifth embodiment of the present invention. In FIG. 16, a light guide plate 32 is constructed by a rectangular transparent resin plate having a thickness corresponding to the diameter of a fluorescent lamp 31. The fluorescent lamp 31 is disposed in a lower end portion of the light guide plate 32. The light guide plate 32 uniformly guides light of the fluorescent lamp 31 onto a sticking face of a color stripe filter 4 on which a color stripe 3 is formed. When the fluorescent lamp 31 is turned on, light from the fluorescent lamp 31 is transmitted to the light guide plate 32 and approximately illuminates a surface of the color stripe filter 4 uniformly.

The light guide plate 32 is fixed to an unillustrated frame formed in the shape of a picture frame. A motor 70 is approximately fixed to this frame in a central position thereof. This motor 70 is constructed by a synchronous motor. A first eccentric cam 71 and a second eccentric cam 72 are attached to an output shaft of this motor 70. Eccentric positions of the first and second eccentric cams 71 and 72 are different from each other with respect to an axis of the output shaft of the motor 70. A first lever 73 having an L-shape is pivotally mounted to an unillustrated frame such that the first lever 73 can be freely swung around a supporting shaft 77 as a supporting point and a longitudinal portion of the first lever 73 can come in contact with the first eccentric cam 71. Similarly, a second lever 74 comes in contact with the second eccentric cam 72.

A first driving pin 75 is fixed to a transversal end portion of the first lever 73. Similarly, a second driving pin 76 is fixed to a transversal end portion of the second lever 74. The first driving pin 75 and the second driving pin 76 are located on an upper right-hand side of the light guide plate 32. A distance between the second driving pin 76 and the supporting shaft 77 is set to be longer than a distance between the first driving pin 75 and the supporting shaft 77. The first and second levers 73 and 74 are respectively pulled by tension springs 78 and 79 engaged with the frame on one end sides thereof. The longitudinal portions of the first and second levers 73 and 74 are respectively pressed against the opposite first and second cams 71 and 72 by biasing the first and second levers 73 and 74 by these tension springs 78 and 79.

First and second adjusting pieces 81 and 82 are supported in positions corresponding to a lower right-hand side portion of the light guide plate 32 such that the first and second adjusting pieces 81 and 82 can be moved in parallel with a transversal direction of the light guide plate 32. These adjusting pieces 81 and 82 are biased by an unillustrated resilient means toward outer sides in moving directions of these adjusting pieces. End tip portions of adjusting screws 83 and 84 are screwed into the frame and respectively come in contact with the first and second adjusting pieces 81 and 82 so that movements of the first and second adjusting pieces 81 and 82 provided by biasing force of this resilient means are respectively prevented by the adjusting screws 83 and 84. Accordingly, when the first and second adjusting screws 83 and 84 are rotated, the first and second adjusting pieces 81 and 82 are moved forward or backward in accordance with respective rotational directions of the adjusting screws. Notches 85 and 86 are formed in side portions of the light guide plate 32 so as not to prevent these forward and backward movements of the first and second adjusting pieces 81 and 82.

In such a structure, the data panel 6 is fixedly attached by fitting the second driving pin 76 into an attachment hole 87 of the data panel 6. In this case, a notch 95 for relief is disposed in a panel portion corresponding to the adjacent first driving pin 75 since the first driving pin 75 is interfered with the second driving pin 76 in attachment.

The attachment hole 87 is located in an eccentric position shifted from a position G1 of the center of gravity of the data panel 6. Therefore, in an attaching state of the data panel 6, the data panel 6 tends to be rotated by moment of its empty weight. However, this rotation is prevented since a side portion of the data panel 6 comes in contact with the second adjusting piece 82.

An image 14 is drawn within an image region of the data panel 6. An image stripe 35 is formed by using many black lines parallel to the transversal direction in a region of the data panel 6 for changing and displaying colors of the image. The adjusting screw 84 is then rotated to adjust the image stripe 35 and the color stripe 3 such that these stripes are parallel to each other.

In accordance with similar procedures, the first driving pin 75 is fitted to an attachment hole 91 of a data panel 90 to attach the data panel 90. A notch 96 for relief with respect to the second driving pin 76 is formed in the second data panel 90. A position of the attachment hole 91 is shifted from a position of the center of gravity of the second data panel 90. Accordingly, the second data panel 90 tends to be rotated by moment of its empty weight. However, this rotation of the second data panel 90 is prevented by the adjusting piece 81. A parallel degree of an image stripe 92 within an image region of the data panel 90 with respect to the color stripe 3 can be easily adjusted by rotating the adjusting screw 83. When the data panel 6 is interfered with the adjusting piece 81 in adjustment, no position of the second data panel 90 can be smoothly adjusted so that a notch 93 for relief is formed in an interference portion of the data panel 6. Similarly, a notch 94 for relief is formed in the data panel 90. The first and second adjusting pieces 81, 82 and the adjusting screws 83, 84 constitute the fine adjusting means 34 in this embodiment. The motor 70, the first and second cams 71, 72 and the first and second levers 73, 74 constitute the driving means in this embodiment.

In such a color display, when the positions of the first and second data panels 6 and 90 are completely adjusted and the motor 70 is driven, the first and second driving pins 75 and 76 are moved along curves in accordance with eccentric amounts of the first and second cams 71 and 72. Thus, each of the data panels 6 and 90 is moved with respect to the color stripe 3 so that the colors of respective images on the data panels are differently changed. A linear moving range required to the data panels is set to about 1 mm in the curved movements of the first and second driving pins 75 and 76 so that there is no problem about a change in coloring.

Figure 17:
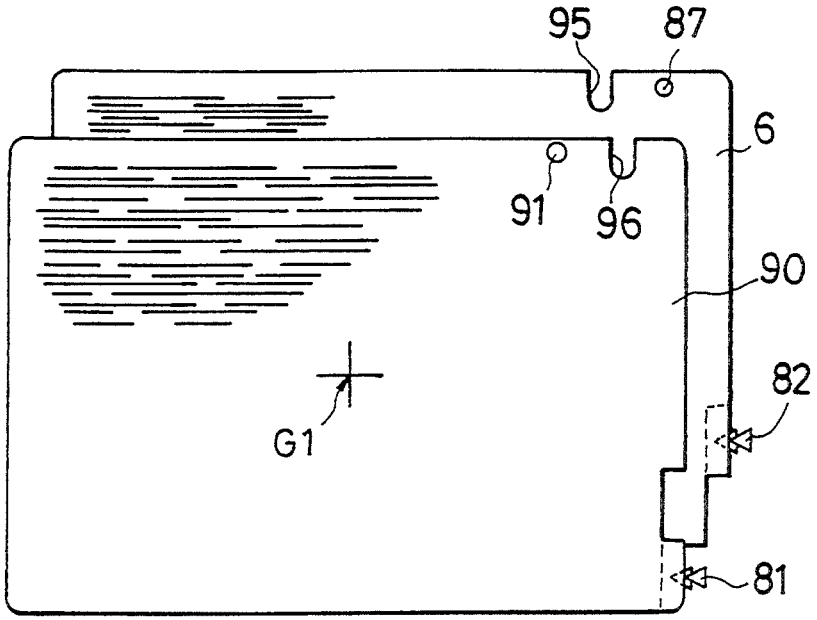
FIG. 17 is a view for schematically explaining a data panel in a state in which the color display in the fifth embodiment of the present invention is transversally arranged.
Figure 18:
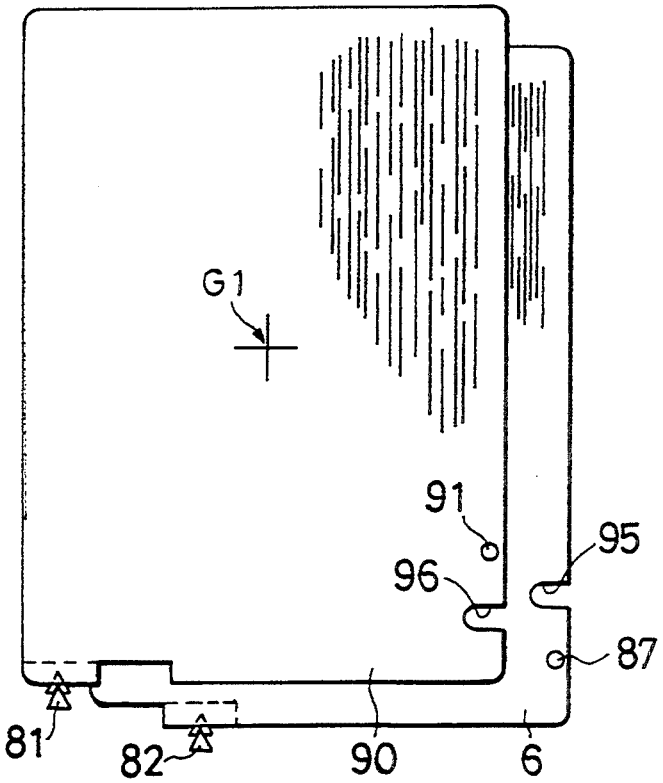
FIG. 18 is a view for schematically explaining the data panel in a state in which the color display in the fifth embodiment of the present invention is longitudinally arranged.

In this embodiment, a plurality of data panels can be attached to a frame, etc. When the plural data panels are overlapped, the colors of an image are greatly changed so that abundant, complicated artistic image colors can be obtained and an accidental artistic image element can be reliably added. Further, the data panels can be exchanged and positions thereof can be easily adjusted by using attachment holes. Since each of the data panels has a single attachment hole, it is easy to process the data panels. Further, since the driving means is disposed in a position G2 of the center of gravity of the color display, the color display can be arranged transversally as shown in FIG. 17 or longitudinally as shown in FIG. 18.

Figure 19:
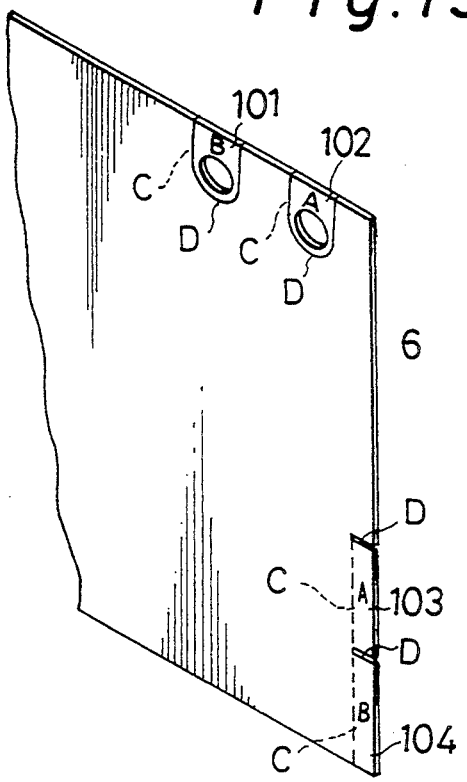
FIG. 19 is a partial perspective view of another data panel in the color display in the fifth embodiment of the present invention.

FIG. 19 shows a color display in accordance with another embodiment of the present invention. In FIG. 19, a cutting portion C shown by a dotted line is disposed in a notch for relief of a driving pin in an upper edge portion of a data panel 6. Further, a cutting portion C shown by a dotted line is disposed in a notch for relief of an adjusting piece in a side edge portion of the data panel 6. Reference numerals 101, 102, 103 and 104 designate notch preparing portions to be cut. In comparison with the data panels 6 and 90 shown in FIG. 16, the attachment hole 91 and the notch 95 in FIG. 16 correspond to the notch preparing portion 101. The notch 96 and the attachment hole 87 in FIG. 16 correspond to the notch preparing portion 102. The notch 93 in FIG. 16 corresponds to the notch preparing portion 103. The notch 94 in FIG. 16 corresponds to the notch preparing portion 104. Accordingly, it is possible to selectively attach each of the data panels 6 and 90 by selecting the notch preparing portions.

A slit D is formed in a main portion of each of the notch preparing portions to hold a mechanical strength thereof and simplify a notch shape. When the notches are formed, marks "A" and "B" for discrimination are written to each of the data panels to prevent an error in discrimination. The data panels can be attached in any one of attaching forms in accordance with the shapes of the notches so that it is sufficient to prepare only one kind of data panels.

Figure 20:
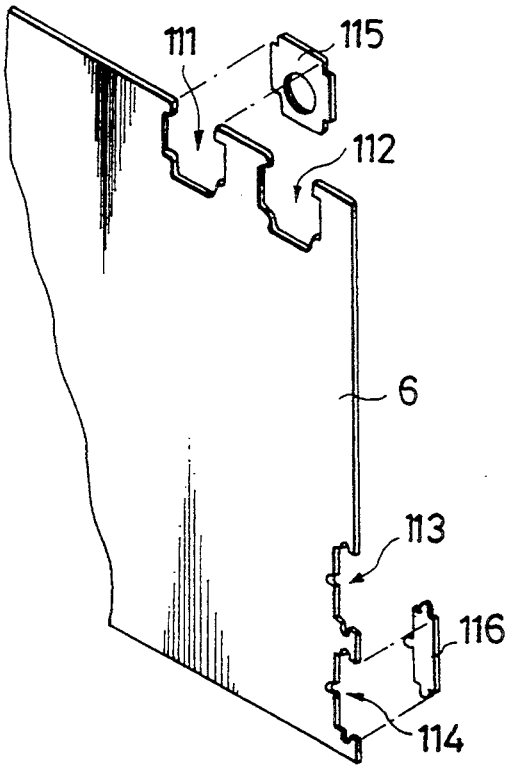
FIG. 20 is a partial perspective view of another data panel in the color display in the fifth embodiment of the present invention.

FIG. 20 shows another embodiment of the data panel 6 shown in FIG. 19. In FIG. 20, a notch is formed in a position corresponding to a notch preparing portion and a molding plate fitted into this notch is detachably attached to the data panel 6. Notches 111, 112, 113 and 114 are formed in the data panel 6. The notches 111 and 112 have a common shape having projected and recessed portions. Accordingly, a molding plate 115 conformed to this common shape of each of the notches 111 and 112 is prepared. The notches 113 and 114 also have a common shape having projected and recessed portions. Accordingly, a molding plate 116 conformed to this common shape of each of the notches 113 and 114 is prepared. These molding plates are fitted into the respective desirable notches and the data panel having the molding plates is then attached to the color display. Accordingly, it is possible to construct the color display by preparing only one kind of data panels 6.

As mentioned above, in accordance with a first structure of the present invention, a color display has a transparent cover glass having a color stripe filter on at least one face thereof; a translucent data film located in proximity to a face of the color stripe filter to overlap and display image information; writing means for writing the information to the data film by selectively making this data film transparent; erasing means for erasing the written information from the data film; writing-erasing control means for controlling operations of the writing and erasing means; winding means for selectively feeding the data film in normal and reverse directions by forming the data film in a web shape, and winding the data film; winding control means for controlling an operation of the winding means; and illuminating means for visualizing these information toward a viewer.

In the first structure, no shift in relative position of the data film and the stripe filter is caused by winding and rewinding the data film having the web shape even when no special device for correcting a running position of the data film is disposed. Accordingly, it is possible to prevent a shift in image color from being caused and improve an image quality. Further, data films can be exchanged simply and efficiently.

In accordance with a second structure of the present invention, the data film in the first structure is constructed by a thermochromic film for thermally writing and erasing the information, and an initial operating state of the data film is set to a light interrupting state of black coloring. The information are recorded and displayed by partially setting the light interrupting state to a decolored transparent state by the writing means.

In the second structure, a texture portion of a display section becomes black so that a color image is brightly displayed in contrast with black. Further, illuminating irregularities of a back light and initializing irregularities of the data film are inconspicuous.

In accordance with a third structure of the present invention, the writing means and the erasing means in the first structure are constructed by the same operating means.

In the third structure, it is not necessary to dispose the erasing means different from the writing means to initialize the data film. Accordingly, the number of parts constituting the color display is reduced so that the color display can be made compact and cost of the color display can be reduced. Further, no shift in track is caused in writing and erasing positions so that no image quality is deteriorated.

In accordance with a fourth structure of the present invention, the data film in the first structure is constructed by a variable message portion composed of a thermochromic film, and an invariable message portion composed of a normal film on which suitable words are printed in advance.

In the fourth structure, it is sufficient to write only required messages so that information can be written efficiently and rapidly. Further, in the writing operation of the information, a display window is covered with a light interrupting film so that no inside structure of the color display can be seen and no appearance of the color display is damaged.

In accordance with a fifth structure of the present invention, a color display has a color stripe filter having a color stripe on at least one face thereof; a translucent data film located in proximity to the color stripe filter to overlap and display image data; means for slightly changing relative positions of the color stripe filter and the data film periodically or non-periodically by locating the data film in proximity to the color stripe filter to overlap and display the image data; and illuminating means for visualizing these image data toward a viewer.

In the fifth structure, it is not necessary to dispose a special device and software for rewriting data so that it takes no time to rewrite data and image data can be cheaply made. Further, colors of characters and images are continuously changed in a state in which the characters and the images are displayed. Accordingly, it is possible to provide a color display greatly appealing and useful to users.

In accordance with a sixth structure of the present invention, the means for slightly changing the relative positions in the fifth structure is constructed by a cam mechanism engaged with the color stripe filter.

In the sixth structure, image colors can be changed cheaply, partially and continuously by a simplified color display.

In accordance with a seventh structure of the present invention, a color display has a color stripe filter having a color stripe on at least one face thereof; a translucent data panel located in proximity to the color stripe filter to overlap and display images and having a stripe image; illuminating means for visualizing these images toward a viewer; means for slightly changing relative positions of the color stripe filter and the data panel in a direction perpendicular to a striping direction of the color stripe filter so as to change colors of an image portion; a swinging pin for supporting the data panel through one attachment hole disposed in an eccentric position of the data panel; fine adjusting means disposed to prevent the data panel from being rotated by moment of its empty weight; and driving means for linearly reciprocating the swinging pin.

In the seventh structure, image colors can be smoothly changed and data panels can be easily exchanged. Further, the image colors can be easily adjusted at an exchanging time of the data panels.

In accordance with an eighth structure of the present invention, the eccentric position of the data panel in the seventh structure is set to an arbitrary position except for a position of the center of gravity of the data panel, and the fine adjusting means has an adjusting screw coming in contact with a side portion of the data panel.

In the eighth structure, it is possible to easily make a skew adjustment of the data panel.

In accordance with a ninth structure of the present invention, a size of the attachment hole of the data panel in the seventh structure is set such that the swinging pin is detachably attached to the attachment hole.

In the ninth structure, data panels can be easily exchanged and image colors can be smoothly changed.

In accordance with a tenth structure of the present invention, the color display in the seventh structure further has a frame body formed in the shape of a picture frame and covering a peripheral portion of a screen of the data panel and a holding member for holding the data panel. A resilient claw member is disposed in the frame body. A receiving member is disposed in the holding member and is detachably engaged with the claw member. The claw member is fitted into the receiving member to attach the frame body to the holding member.

In the tenth structure, the frame body can be easily attached to the holding member.

In accordance with an eleventh structure of the present invention, a color display has a color stripe filter having a color stripe on at least one face thereof; a translucent data panel located in proximity to the color stripe filter to overlap and display images and having a stripe image; illuminating means for visualizing these images toward a viewer; means for slightly changing relative positions of the color stripe filter and the data panel in a direction perpendicular to a striping direction of the color stripe filter so as to change colors of an image portion; a driving pin for supporting the data panel through one attachment hole disposed in an eccentric position of the data panel and constantly moved; fine adjusting means disposed to prevent the data panel from being rotated by moment of its empty weight; and driving means for moving the driving pin.

In the eleventh structure, image colors can be smoothly changed and data panels can be easily exchanged. The image colors can be easily adjusted at an exchanging time of the data panels.

In accordance with a twelfth structure of the present invention, the color display in the eleventh structure has plural fine adjusting means, plural driving pins and plural driving means so that a plurality of data panels can be simultaneously displayed.

In accordance with a thirteenth structure of the present invention, each of the fine adjusting means, the driving pin and the driving means in the eleventh structure is located in an arbitrary position shifted from a position of the center of gravity of the data panel.

In the thirteenth structure, image colors can be easily adjusted at an exchanging time of data panels.

In accordance with a fourteenth structure of the present invention, each of portions of the data panel corresponding to plural fine adjusting means and the driving pin in the eleventh structure is cut in the shape of a broken line along the shape of a preset notch for relief.

In the fourteenth structure, it is sufficient to prepare only one kind of data panels and the plural data panels can be smoothly moved without any mutual interference of the data panels.

In accordance with a fifteenth structure of the present invention, the data panel in the eleventh or fourteenth structure has discrimination marks respectively corresponding to the notch shapes so that the notches can be reliably formed.

In accordance with a sixteenth structure of the present invention, the data panel in the eleventh, fourteenth or fifteenth structure has notches for relief formed in panel portions corresponding to plural fine adjusting means and the driving pin, and a molding plate fitted into each of the notches is detachably disposed.

In the sixteenth structure, it is sufficient to prepare only one kind of data panels.

In accordance with a seventeenth structure of the present invention, the driving means in the eleventh structure moves the driving pin along a curve so that image colors can be smoothly changed.

In accordance with an eighteenth structure of the present invention, the driving means in the eleventh structure is approximately arranged in the center of gravity of the color display so that the color display can be arranged transversally or longitudinally.

Many widely different embodiments of the present invention may be constructed without departing from the spirit and scope of the present invention. It should be understood that the present invention is not limited to the specific embodiments described in the specification, except as defined in the appended claims.

What is claimed is:

1. A color display comprising:

a transparent cover glass having a color stripe filter on at least one face thereof;

a data film in a web shape located in proximity to a face of said color stripe filter to overlap and display image information, said data film being constructed by a thermochromic film having a coloring state which is thermally changed between a light interrupting state having a black coloring and a decolored transparent state, and an initial operating state of said data film being set to the light interrupting state having a black coloring;

winding means for selectively feeding the data film in first and second directions by winding the data film, with the second direction a reverse direction relative to said first direction;

a single thermal head for writing the image information on the data film by partially setting the light interrupting state of the data film to the decolored transparent state on winding the data film in the first direction by the winding means, and for thermally erasing the written image information from the data film by setting the decolored transparent state of the data film to the light interrupting state on winding the data film in the second direction by the winding means;

writing-erasing control means for controlling an operation of the thermal head;

means for controlling an operation of the winding means; and illuminating means for visualizing the image information toward a viewer.

2. A color display as claimed in claim 1, wherein the data film is constructed by a variable message portion composed of a thermochromic film, and an invariable message portion composed of a normal film on which suitable words are printed in advance.

3. A color display comprising:

a color stripe filter having a color stripe on at least one face thereof;

a data film having a stripe image of black coloring located in proximity to said color stripe filter to overlap and display image data, said data film being constructed by a thermochromic film having a coloring state which is thermally changed between a light interrupting state having a black coloring and a decolored transparent state;

means for slightly changing relative positions of the color stripe filter and the data film periodically or non-periodically to slightly change the colors of respective portions of displayed image data, said means for slightly changing the relative positions being constructed by a cam mechanism engaged with the color stripe filter; and illuminating means for visualizing the image data toward a viewer.

4. A color display comprising:

a color stripe filter having a color stripe on at least one face thereof;

a data panel of a translucent plate having a stripe image of black coloring located in proximity to said color stripe filter to overlap and display images;

illuminating means for visualizing the images toward a viewer;

means for slightly changing relative positions of the color stripe filter and the data panel in a direction perpendicular to a striping direction of the color stripe filter so as to change colors of an image portion;

a swinging pin for supporting the data panel through one attachment hole disposed in an eccentric position of the data panel set to an arbitrary position except for a position of a center of gravity of the data panel;

fine adjusting means disposed to prevent the data panel from being rotated by moment of its empty weight, said fine adjusting means having an adjusting screw coming in contact with a side portion of the data panel; and driving means for linearly reciprocating said swinging pin.

5. A color display as claimed in claim 4, wherein a size of the attachment hole of the data panel is set such that the swinging pin is detachably attached to the attachment hole.

6. A color display as claimed in claim 4, wherein the color display further comprises a frame body formed in the shape of a picture frame and covering a peripheral portion of a screen of the data panel and a holding member for holding the data panel;

a resilient claw member is disposed in the frame body;

a receiving member is disposed in the holding member and is detachably engaged with the claw member; and the claw member is fitted into the receiving member to attach the frame body to the holding member.

7. A color display comprising:

a color stripe filter having a color stripe on at least one face thereof;

a data panel of a translucent plate having a stripe image of black coloring located in proximity to said color stripe filter to overlap and display images;

illuminating means for visualizing the images toward a viewer;

means for slightly changing relative positions of the color stripe filter and the data panel in a direction perpendicular to a striping direction of the color stripe filter so as to change colors of an image portion;

a driving pin for supporting the data panel through one attachment hole disposed in an eccentric position of the data panel and constantly moved;

fine adjusting means disposed to prevent the data panel from being rotated by moment of its empty weight; and driving means for moving said driving pin;

wherein each of said fine adjusting means, said driving pin and said driving means is located in an arbitrary position shifted from a position of a center of gravity of the data panel.

8. A color display as claimed in claim 7, wherein the color display has plural fine adjusting means, plural driving pins and plural driving means.

9. A color display as claimed in claim 7, wherein each of portions of the data panel corresponding to plural fine adjusting means and the driving pin is cut in the shape of a broken line along the shape of a preset notch for relief.

10. A color display as claimed in claim 9, wherein the data panel has discrimination marks respectively corresponding to the notch shapes.

11. A color display as claimed in claim 7, 9 or 10, wherein the data panel has notches for relief formed in panel portions corresponding to plural fine adjusting means and the driving pin, and a molding plate fitted into each of the notches is detachably disposed.

12. A color display as claimed in claim 7, wherein the driving means moves the driving pin along a curve.

13. A color display as claimed in claim 7, wherein the driving means is approximately arranged in the center of gravity of the color display.

* * * * *